US012774587B2

(12) United States Patent
Nishikawa et al.

(10) Patent No.: US 12,774,587 B2
(45) Date of Patent: Oct. 27, 2026

(54) CONSTRUCTION MACHINE CONFIGURED TO PERFORM OPERATION LIMITING CONTROL TO LIMIT THE OPERATION OF AN ACTUATOR WHEN AN OBSTACLE SENSOR DETECTS AN OBSTACLE

(71) Applicant: HITACHI CONSTRUCTION MACHINERY CO., LTD., Tokyo (JP)

(72) Inventors: Shinji Nishikawa, Kasumigaura (JP); Koji Shiwaku, Tsuchiura (JP); Shinjiro Yamamoto, Inashiki-gun (JP); Ryota Kameoka, Ishioka (JP); Akihiro Narazaki, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 3 days.

(21) Appl. No.: 19/173,896

(22) Filed: Apr. 9, 2025

(65) Prior Publication Data

US 2025/0237037 A1 Jul. 24, 2025

Related U.S. Application Data

(63) Continuation of application No. 17/623,637, filed as application No. PCT/JP2020/023097 on Jun. 11, 2020, now abandoned.

(30) Foreign Application Priority Data

Sep. 25, 2019 (JP) ..... 2019-174667

(51) Int. Cl.
*E02F 9/24* (2006.01)
*E02F 9/20* (2006.01)
(Continued)

(52) U.S. Cl.
CPC ..... *E02F 9/24* (2013.01); *E02F 9/2033* (2013.01); *E02F 9/2235* (2013.01);
(Continued)

(58) Field of Classification Search
CPC ... E02F 9/20; E02F 9/24; E02F 9/2033; E02F 9/2235; E02F 9/2246; E02F 9/2296;
(Continued)

(56) References Cited

U.S. PATENT DOCUMENTS 5,801,667 A 9/1998 Shimizu
7,894,951 B2 2/2011 Norris
(Continued)

FOREIGN PATENT DOCUMENTS

JP 08-302748 A 11/1996
JP 2009-114750 A 5/2009
(Continued)

OTHER PUBLICATIONS

International Search Report of PCT/JP2020/023097 dated Aug. 18, 2020.
(Continued)

*Primary Examiner* — Andrew R Dyer
(74) *Attorney, Agent, or Firm* — MATTINGLY & MALUR, PC

(57) ABSTRACT

There is provided a construction machine that achieves both safety and operability by lowering the possibility of an accident due to contact between the construction machine and a worker in the periphery of a vehicle body while securing operability in situations where an object required for work is present in the periphery. A controller has a normal mode as a control mode for making the operation limiting control effective and a temporary cancelation mode as a control mode for temporarily canceling the operation limiting control. The controller shifts to the temporary
(Continued)

cancelation mode in response to operation of the control canceling device while in the normal mode. The controller shifts back to the normal mode in a case where a predetermined condition not responsive to operation of the control canceling device is satisfied while in the temporary cancelation mode.

3 Claims, 15 Drawing Sheets

(51) Int. Cl.
*E02F 9/22* (2006.01)
*E02F 9/26* (2006.01)

(52) U.S. Cl.
CPC ..... *E02F 9/2246* (2013.01); *E02F 9/2296* (2013.01); *E02F 9/262* (2013.01)

(58) Field of Classification Search
CPC ..... E02F 9/262; E02F 9/261; E02F 3/435; B60R 21/0134; B60R 21/34; B60R 2021/0081; B60R 2021/01286
USPC ..... 701/5
See application file for complete search history.

(56) References Cited

U.S. PATENT DOCUMENTS

| | | | | |
|---|---|---|---|---|
| 9,763,377 | B2 | 9/2017 | Yokoyama | |
| 10,377,365 | B2 | 8/2019 | Ono | |
| 2011/0173964 | A1* | 7/2011 | Takahashi | E02F 9/2232 60/451 |
| 2012/0000191 | A1* | 1/2012 | Hagiwara | B01D 46/42 60/311 |
| 2012/0003069 | A1* | 1/2012 | Hagiwara | E02F 9/2285 414/685 |
| 2013/0227936 | A1* | 9/2013 | Takahashi | F15B 11/165 60/297 |
| 2013/0325235 | A1* | 12/2013 | Kurikuma | E02F 9/2246 701/22 |
| 2014/0118533 | A1 | 5/2014 | Chang | |
| 2017/0248946 | A1 | 8/2017 | Ogura | |
| 2017/0280621 | A1 | 10/2017 | Kawai | |
| 2018/0001887 | A1 | 1/2018 | Watanabe | |
| 2018/0043868 | A1 | 2/2018 | Ge | |
| 2018/0209122 | A1 | 7/2018 | Kiyota et al. | |
| 2018/0334979 | A1 | 11/2018 | Watson | |
| 2019/0168776 | A1 | 6/2019 | Imaizumi | |
| 2019/0284782 | A1 | 9/2019 | Izumikawa | |
| 2019/0360177 | A1* | 11/2019 | Kiyota | B60R 1/23 |
| 2020/0217049 | A1* | 7/2020 | Mizuochi | H04W 4/025 |
| 2020/0239021 | A1 | 7/2020 | Igarashi | |
| 2020/0291614 | A1 | 9/2020 | Kiyota | |
| 2020/0399863 | A1 | 12/2020 | Aizawa | |
| 2021/0071394 | A1* | 3/2021 | Kean | B60R 1/26 |
| 2021/0237719 | A1 | 8/2021 | Chen | |
| 2021/0262196 | A1 | 8/2021 | Ito | |
| 2021/0270013 | A1* | 9/2021 | Nishi | E02F 9/264 |
| 2022/0002970 | A1* | 1/2022 | Kurosawa | E02F 3/435 |
| 2022/0002978 | A1* | 1/2022 | Kurosawa | E02F 9/261 |
| 2022/0106765 | A1 | 4/2022 | Sasaki | |
| 2022/0154427 | A1* | 5/2022 | Misaki | E02F 9/2267 |

FOREIGN PATENT DOCUMENTS

| | | | |
|---|---|---|---|
| JP | 2015-229837 | A | 12/2015 |
| JP | 2018-197491 | A | 12/2018 |
| WO | 2018/105527 | A1 | 6/2018 |

OTHER PUBLICATIONS

International Preliminary Report on Patentability received in corresponding International Application No. PCT/JP2020/023097 dated Apr. 7, 2022.

* cited by examiner

CONSTRUCTION MACHINE CONFIGURED TO PERFORM OPERATION LIMITING CONTROL TO LIMIT THE OPERATION OF AN ACTUATOR WHEN AN OBSTACLE SENSOR DETECTS AN OBSTACLE

TECHNICAL FIELD

The present invention relates to a construction machine having a function to detect an obstacle (a person or an object) in the periphery of the vehicle body thereof and to limit operation of the vehicle body depending on the detected obstacle in order to reduce the possibility that the vehicle body and the obstacle in the periphery thereof contact each other.

BACKGROUND ART

One form of accident caused by a construction machine is assumed to be physical contact between the construction machine and a worker in the periphery thereof. As means for avoiding causing accidents, there have been proposed many systems for detecting an obstacle (a person or an object), in the periphery by sensors and indicating the obstacle to an operator and also many construction machines and controllers thereof for limiting the speed at which a vehicle body operates and automatically stopping the vehicle body when an obstacle is detected in the periphery.

However, in actual situations where a construction machine is to operate, it may be unavoidable for the construction machine to operate with an obstacle (a person or an object), present in the periphery of the vehicle body thereof, such as when the construction machine should operate in environments where some kind of object (e.g., a gravel mound to be loaded onto a dump truck, an earth retaining wall, another construction machine, a dump truck, etc.) is present in the periphery of the construction machine, or when the construction machine should perform work with a worker placed in the periphery with the operator's and worker's consent.

Apart from the above situations, in a case where it is difficult to remove an obstacle away from a construction machine when the construction machine detects the obstacle and operation limitation is enabled, a need arises to move the construction machine from the site with the obstacle being detected.

In view of such a situation, there has been a construction machine having a function to limit operation of its vehicle body when an obstacle in the periphery thereof is detected. The construction machine includes means for allowing the operator to cancel the limitation on the operation. When the operator actuates the canceling means, the vehicle body can be moved as is the case with ordinary hydraulic excavators with the obstacle being detected.

Patent Document 1 discloses, as an invention relating to a method of canceling operation limitation, a construction machine that, when operation limitation is enabled upon detection of a person, allows predetermined operation in the cabin to cancel the limitation on operation and that changes the gradualness of returning from the limitation on operation depending on whether the obstacle is detected or not at the time the limitation on operation is to be canceled.

PRIOR ART DOCUMENT

Patent Document

Patent Document 1: PCT Patent Publication No. WO2018/105527

SUMMARY OF THE INVENTION

Problems to be Solved by the Invention

Patent Document 1 proposes a method that permits the operator to cancel operation limitation when an obstacle is detected, by making particular canceling operation, the method canceling the limitation on operation more safely by avoiding an abrupt velocity change upon cancelation.

According to the conventional art including Patent Document 1, although the function to cancel operation limitation is referred to, situations where cancelation is required are treated as irregular, and no consideration has been made with respect to a way of permitting the construction machine to be used continuously with the limitation on operation being canceled.

Furthermore, although Patent Document 1 refers to the method of canceling operation limitation, it does not clearly refer to a method of returning from a state where the limitation on operation is canceled to a normal state where vehicle body operation is limited upon detection of a person.

If a function to detect a peripheral obstacle is good enough to detect only an obstacle that needs to be really detected (e.g., a person who unexpectedly enters a work area), then any situations where operation limitation is to be canceled do not essentially arise during normal work, and may be referred to as irregular. However, since current construction machines where the ability of a detecting function is under development are sufficiently assumed to work in situations where some kind of object is present in the periphery of the vehicle body, it is necessary for achieving both safety and operability to construct a driver assisting function based on the premise of using a construction machine in a manner of positively permitting situations where the construction machine operates with operation limitation being canceled.

A construction machine that is assumed to work in situations where some kind of object is present in the periphery of the vehicle body may detect an object that is required for work (e.g., a gravel mound to be loaded onto a dump truck) during normal work. Limiting operation of the vehicle body upon detection of such an object prevents the construction machine from performing well in originally intended use as a work machine, giving rise to the problem of a significant reduction in work performance.

When the operator cancels the limitation on operation in order not to lower operability, as disclosed in the background art, the construction machine is able to work, as in the past, with no limitation on operation even if there is an obstacle in the periphery. However, inasmuch as the function to avoid an accident due to contact between the construction machine and a peripheral worker does not work naturally, a problem arises in that safety does not increase as originally intended.

After the operator has canceled the limitation on operation and done necessary work, the operator should effectively reinstate the limitation on operation each time it is required, depending on the environment in which the construction machine operates. In the event that the operator forgets to take an operation to reinstate operation limitation, another problem tends to arise in that the operator may take it for granted that the limitation on operation is enabled and may overlook a check around the construction machine.

The present invention has been made in order to solve the above problems. It is an object of the present invention to provide a construction machine that achieves both safety and operability by lowering the possibility of an accident due to contact between the construction machine and a worker in the periphery of the vehicle body while securing operability in situations where an object required for work is present in the periphery.

Means for Solving the Problems

In order to accomplish the above object, there is provided according to the present invention a construction machine including an actuator, an obstacle sensor for detecting an obstacle in a periphery of the construction machine, a controller for performing operation limiting control to limit operation of the actuator in a case where the obstacle sensor detects an obstacle, and a control canceling device for instructing the controller to cancel the operation limiting control. In the construction machine, the controller is configured to have a normal mode as a control mode for making the operation limiting control effective and a temporary cancelation mode as a control mode for temporarily canceling the operation limiting control, shift to the temporary cancelation mode in response to operation of the control canceling device while in the normal mode, and shift back to the normal mode in a case where a predetermined condition not responsive to operation of the control canceling device is satisfied while in the temporary cancelation mode.

According to the present invention, as described above, since the controller switches from the normal mode in which operation limitation is enabled to the temporary cancelation mode in which operation limitation is not enabled, in response to operation of the control canceling device, it is possible for the construction machine to secure operability in situations where an object required for work is present in the periphery of the vehicle body. In addition, when the predetermined condition not responsive to the operation of the control canceling device is satisfied while in the temporary cancelation mode, the controller returns to the normal mode independently of the operation of the control canceling device, making it possible to reduce the possibility of an accident due to contact between the construction machine and a worker in the periphery thereof.

Advantages of the Invention

The construction machine according to the present invention achieves both safety and operability by lowering the possibility of an accident due to contact between the construction machine and a worker in the periphery of the vehicle body while securing operability in situations where an object required for work is present in the periphery.

MODES FOR CARRYING OUT THE INVENTION

Figure 1:
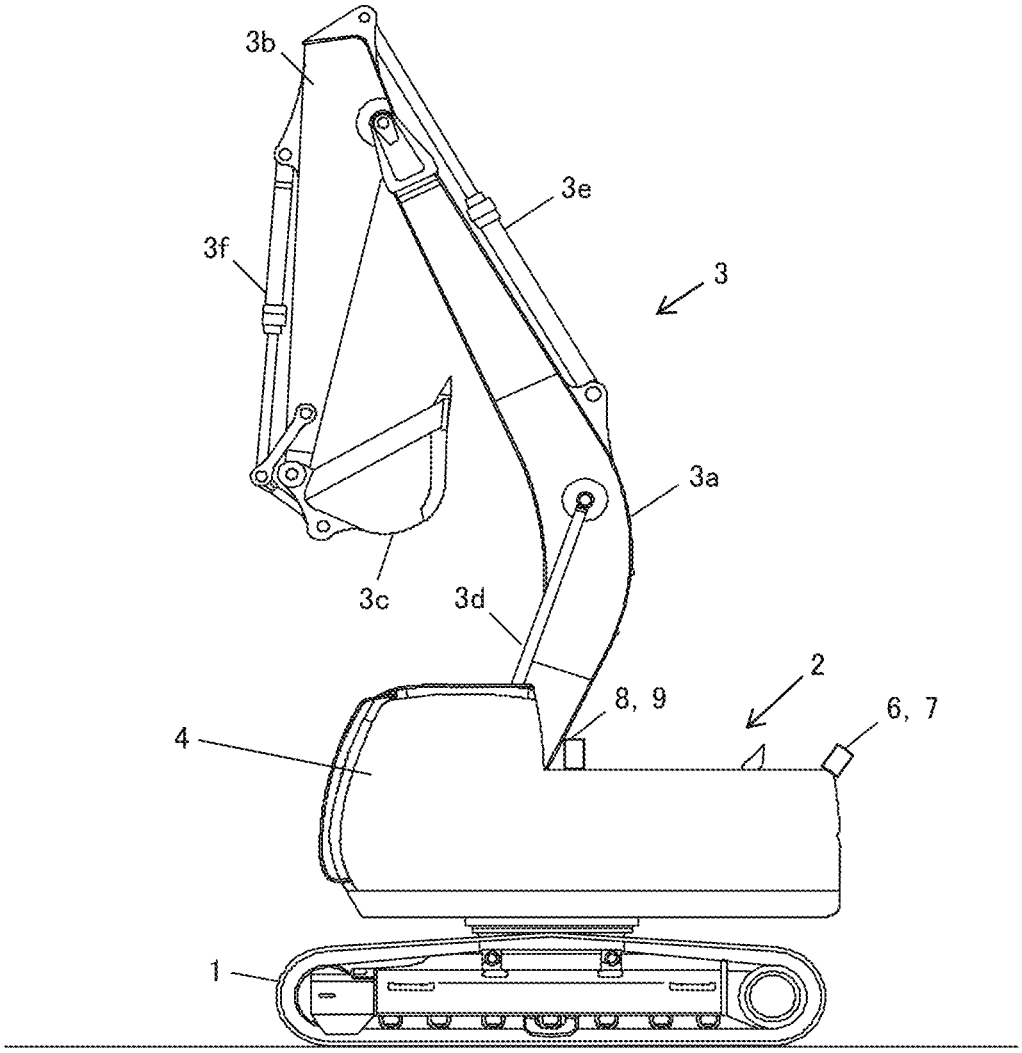
FIG. 1 is a view illustrating an appearance of a hydraulic excavator as an example of a construction machine according to a first embodiment of the present invention.

Embodiments of the present invention will be described hereinbelow with reference to the drawings. In the drawings, equivalent components are denoted by identical referenced characters throughout views, and redundant description thereof will be omitted.

First Embodiment

Description of a Hydraulic Excavator

FIG. 1 is a view illustrating an appearance of a hydraulic excavator as an example of a construction machine according to a first embodiment of the present invention.

In FIG. 1, the hydraulic excavator (construction machine) includes a crawler-type lower track structure 1, an upper swing structure 2 swingably mounted on the lower track structure 1, and a front implement 3 for performing excavating work or the like.

The lower track structure 1 includes a pair of left and right track hydraulic motors (not illustrated) and has crawlers independently rotatable to move forwardly and rearwardly by the track hydraulic motors and speed reducer mechanisms thereof, etc.

The upper swing structure 2 includes a cabin 4 housing therein operation devices for controlling the hydraulic excavator to operate in various ways, a prime mover such as an engine, a hydraulic pump and a swing motor (not illustrated), etc. The swing motor swings the upper swing structure 2 leftwardly or rightwardly with respect to the lower track structure 1. The cabin 4 houses therein a display device 5 (illustrated in FIG. 2) for displaying various instruments and machine body information that allow an operator to check the situation of the hydraulic excavator (work machine).

The front implement 3 includes a boom 3*a*, an arm 3*b*, and a bucket 3*c*. The boom 3*a* is vertically moved by a boom cylinder 3*d*. The arm 3*b* is operated toward a dumping side (opening side) or a crowding side (gathering side) by an arm cylinder 3*e*. The bucket 3*c* is operated toward the dumping side or the crowding side by a bucket cylinder 3*f*.

(Description Regarding Obstacle Sensors)

3D sensors 6, 7, 8, and 9 as obstacle sensors for detecting a peripheral obstacle are mounted on the vehicle body of the hydraulic excavator respectively at rear, left, and right ends thereof. Each of the 3D sensors includes an infrared sensor of the TOF (Time-Of-Flight) type, determines whether an object is detected or not in a predetermined detection range, determines in itself whether an obstacle is detected or not, and outputs the determined result by CAN communication.

(Description Regarding Obstacle Sensors and Detection Areas)

Figure 2:
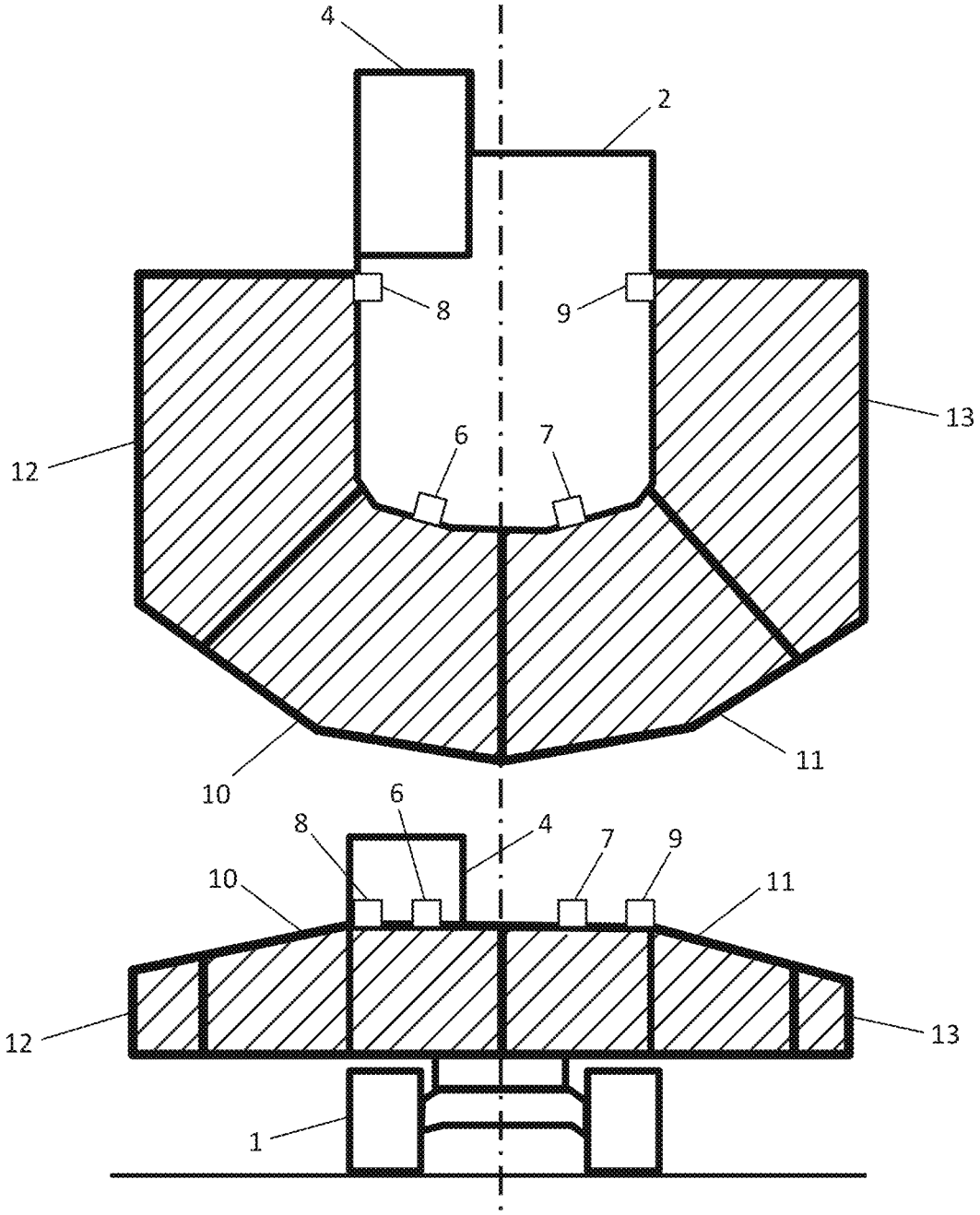
FIG. 2 is a view illustrating positions where obstacle sensors are installed and detection areas according to the first embodiment of the present invention.

FIG. 2 is a view illustrating positions where the obstacle sensors (3D sensors 6 through 9) are installed and the detection areas thereof.

The 3D sensor 6 is mounted on a left side of the rear end of the vehicle body. The 3D sensor 7 is mounted on a right side of the rear end of the vehicle body. The 3D sensor 8 is mounted on the left end of the vehicle body. The 3D sensor 9 is mounted on the right end of the vehicle body. The 3D sensors are given respective spatial extents (angles) established therefor that are vertically and horizontally detectable. The detection ranges of these four 3D sensors cover a space behind the vehicle body in the periphery thereof.

Using the detection ranges of the 3D sensors, there are established detection areas for lowering the possibility of an accident caused by contact between the construction machine, i.e., the hydraulic excavator, that is about to move and a peripheral worker. Specifically, the detection areas are established to detect an obstacle that is present in an area where the upper swing structure 2 moves in a short period of time when the hydraulic excavator is about to swing and travel. The area detected by the 3D sensor 6 is defined as a detection area 10, the area detected by the 3D sensor 7 as a detection area 11, the area detected by the 3D sensor 8 as a detection area 12, and the area detected by the 3D sensor 9 as a detection area 13.

The detection areas 10 through 13 are established in a position higher than the lower track structure 1 such that the crawlers of the lower track structure 1 is not detected as an obstacle.

(Description Regarding a State Regarded as Obstacle Detection)

The 3D sensors 6 through 9 determine whether an obstacle is present in the respective detection areas 10 through 13 or not.

According to the present embodiment, the time at which the 3D sensors 6 through 9 detect one or more obstacles (persons or objects) that are present in the detection areas 10 through 13 provided by the 3D sensors 6 through 9 as the obstacle sensors is regarded as an obstacle detection time.

(Description of a System Configuration; Components of an Ordinary Hydraulic Excavator)

Figure 3:
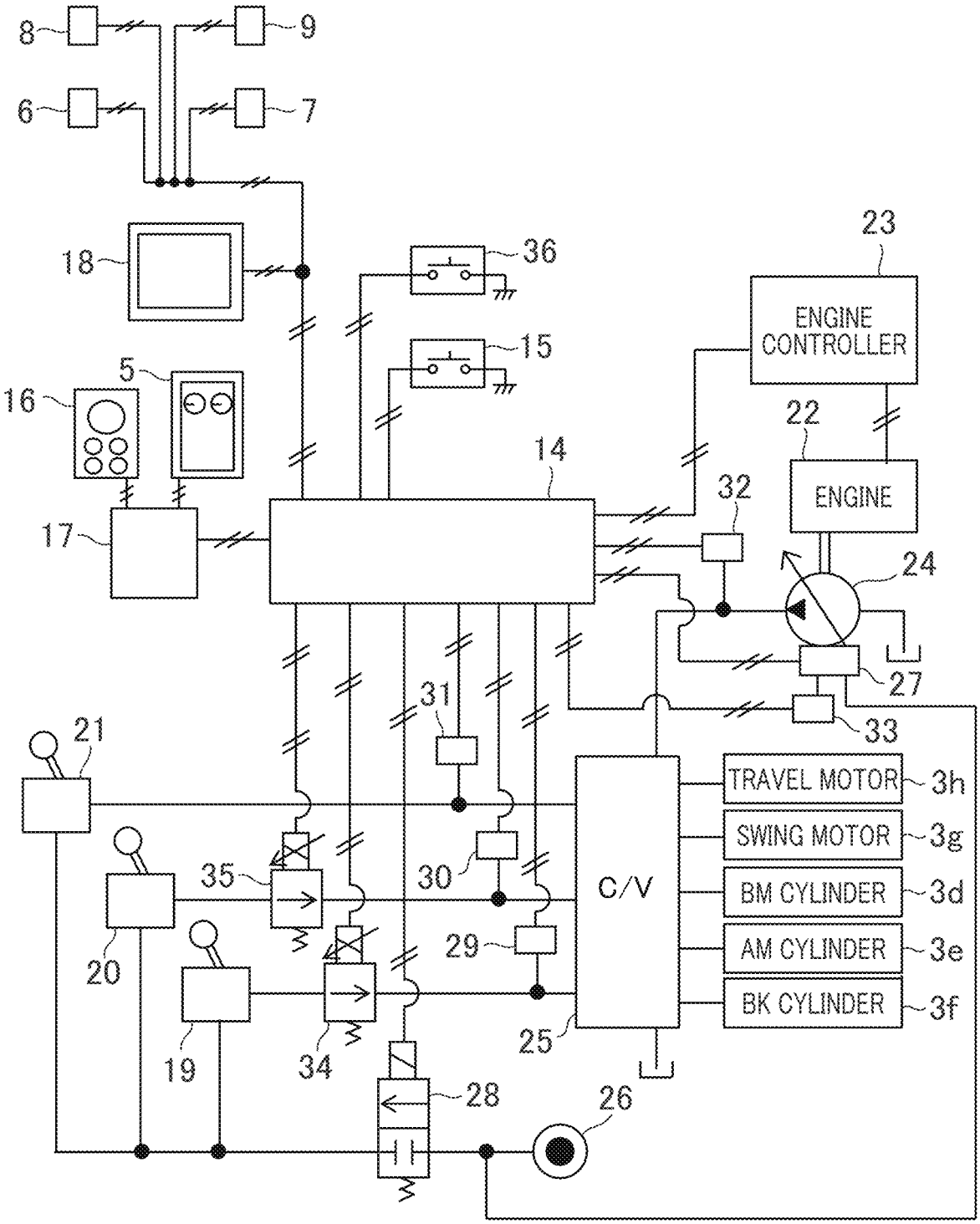
FIG. 3 is a diagram illustrating a system configuration according to the first embodiment of the present invention.

FIG. 3 is a diagram illustrating a system configuration according to the present embodiment.

The cabin 4 of the hydraulic excavator according to the present embodiment houses therein a vehicle body controller 14 for controlling operation of the construction machine in whole, a lock switch 15 as a lever switch for operating an operation lock device that selectively locks and unlocks operation of the vehicle body in whole, the display device 5 for displaying various instruments and machine body information that allow the operator to check the situation of the hydraulic excavator, a switch box 16 for manually changing engine rotational speeds and operating the display device 5, and a monitor controller 17 for accepting various switch input signals from the switch box 16 and changing displayed contents of the display device 5.

The cabin 4 of the hydraulic excavator also houses therein the operation devices for controlling the hydraulic excavator to operate in various ways. In FIG. 3, the operation devices are illustrated as three representative operation levers including a swing operation lever 19 for indicating either left swing operation or right swing operation, a travel operation lever 20 for indicating either right forward travel operation, right rearward travel operation, left forward travel operation, or left rearward travel operation, and a front implement operation lever 21 for indicating either boom raising operation, boom lowering operation, arm crowding operation, arm dumping operation, bucket crowding operation, or bucket dumping operation.

The hydraulic excavator according to the present embodiment includes an engine 22 as the prime mover and an engine controller 23 electrically connected to the engine 22. The engine controller 23 identifies the state of the engine 22 from signals from a temperature sensor and a pickup sensor that are incorporated in the engine 22, and controls valves and so on included in the engine 22, to control the rotational speed and torque of the engine 22.

The vehicle body controller 14, the monitor controller 17, and the engine controller 23 are electrically connected to each other by CAN communication, and send and receive necessary information.

Regarding engine rotational speed control, for example, the vehicle body controller 14 determines a target engine rotational speed depending on an engine control dial voltage, operation states of the operation levers 19 through 21, a pump load state, and a temperature condition, and sends the determined target engine rotational speed to the engine controller 23. The engine controller 23 controls the engine 22 to achieve the target engine rotational speed, calculates an actual engine rotational speed from the signal from the pickup sensor incorporated in the engine 22, and sends the calculated actual engine rotational speed to the vehicle body controller 14. As the monitor controller 17 can acquire the target engine rotational speed and the actual engine rotational speed that are present in the CAN communication, the monitor controller 17 can control the display device 5 to display the target engine rotational speed and the actual target engine rotational speed as one of displayed states of the vehicle body.

A hydraulic operating fluid delivered from a variable-displacement-type hydraulic pump 24 that is actuated by the engine 22 flows through a control valve 25 that controls a fluid flow toward hydraulic actuators and is supplied to a travel motor 3*h*, a swing motor 3*g*, the boom cylinder 3*d*, the arm cylinder 3*e*, and the bucket cylinder 3*f* as these hydraulic actuators.

Normally, the hydraulic excavator includes a plurality of hydraulic pumps for simultaneously operating a plurality of hydraulic actuators. In FIG. 3, one of those hydraulic pumps is illustrated as a representative hydraulic pump.

Each of the operation levers 19 through 21 includes a pilot valve as a manual pressure reducing valve, and reduces a primary pressure depending on the lever operation amount to generate a pilot valve secondary pressure. The generated secondary pressures from the operation levers 19 through 21 move a plurality of spools (directional control valves) in the control valve 25, adjusting the flow of the hydraulic operating fluid delivered from the hydraulic pump 24 to operate the corresponding hydraulic actuators.

A hydraulic fluid source 26 supplied from a pilot pump actuated by the engine 22 supplies a hydraulic operating fluid to a pump regulator 27 and a lock valve 28 as the operation lock device. The hydraulic operating fluid supplied from the hydraulic fluid source 26 is kept under a pilot valve primary pressure of 4 MPa by an unillustrated pilot relief valve.

The pump regulator 27 includes a pump flow rate control solenoid valve as a solenoid proportional valve that reduces and uses the pilot valve primary pressure from the hydraulic fluid source 26. The pump flow rate control solenoid valve reduces the pilot valve primary pressure depending on an electric current (mA) outputted from the vehicle body controller 14. The pump regulator 27 incorporates a tilting (displacement volume) control mechanism for the pump 24, and controls the volume (or delivery flow rate) of the pump 24 depending on an output pressure (secondary pressure) from the pump flow rate control solenoid valve.

The pump regulator 27 has such characteristics that it makes the pump volume minimum under a minimum pump flow rate control pressure (0 MPa) and it makes the pump volume maximum under a maximum pump flow rate control pressure (4 MPa).

The pump flow rate control solenoid valve is in an interruption position (0 MPa) when in an uncontrolled state (0 mA), and has such characteristics that the pump flow rate control pressure increases as the vehicle body controller 14 increases a command electric current.

The pump regulator 27 is combined with a pump flow rate control pressure sensor 33 that is used for detecting the pump flow rate control pressure.

A signal from the pump flow rate control pressure sensor 33 is inputted to the vehicle body controller 14, which estimates a pump displacement from the characteristics of pump displacements with respect to pump flow rate control pressures and multiplies the estimated pump displacement by the engine rotational speed, thereby calculating a delivery flow rate of the hydraulic operating fluid delivered from the hydraulic pump 24.

The lock valve 28 is the operation lock device that selectively locks and unlocks operation of the vehicle body in whole. The lock valve 28 is switched between an interruption position and a fluid communication position by a solenoid actuated by the vehicle body controller 14.

When a lock lever (not illustrated) disposed in the cabin 4 is in a locked position, the lock switch 15 is OFF (its terminals are open or disconnected). The vehicle body controller 14 monitors the state of the lock switch 15, and de-energizes the lock valve 28 (holds the lock valve 28 in the interruption position) when the lock switch 15 is OFF.

When the lock lever disposed in the cabin 4 is in an unlocked position, lock switch 15 is ON (its terminals are connected). The vehicle body controller 14 monitors the state of the lock switch 15, and energizes the lock valve 28 (holds the lock valve 28 in the fluid communication position) by applying 24 V to the lock valve 28 when the lock switch 15 is ON.

When the lock valve 28 is in the interruption position, the swing operation lever 19, the travel operation lever 20, and the front implement operation lever 21 are not supplied with the pilot valve primary pressure. Thus, even when the operation levers 19 through 21 are operated, since the pilot valve secondary pressure does not increase and is unable to shift the spools in the control valve 25, the vehicle body is operationally disabled in whole.

When the lock valve 28 is in the fluid communication position, the swing operation lever 19, the travel operation lever 20, and the front implement operation lever 21 are supplied with the pilot valve primary pressure. Thus, depending on operation of the operation levers 19 through 21, the pilot valve secondary pressure increases and is able to shift the spools in the control valve 25, so that the vehicle body becomes operational.

A swing operation pressure sensor 29 for detecting the pilot valve secondary pressure is included in a pilot circuit between the swing operation lever 19 and the control valve 25. A travel operation pressure sensor 30 for detecting the pilot valve secondary pressure is included in a pilot circuit between the travel operation lever 20 and the control valve 25. A front implement operation pressure sensor 31 for detecting the pilot valve secondary pressure is included in a pilot circuit between the front implement operation lever 21 and the control valve 25.

Signals from the swing operation pressure sensor 29, the travel operation pressure sensor 30, and the front implement operation pressure sensor 31 are inputted to the vehicle body controller 14, which identifies the situation in which the hydraulic excavator is operated.

The vehicle body controller 14 determines whether the vehicle body is operated or not on the basis of the signals inputted from the operation pressure sensors 29 through 31.

A pump delivery pressure sensor 32 for detecting a pump delivery pressure is included in a delivery circuit between the hydraulic pump 24 and the control valve 25.

A signal from the pump delivery pressure sensor 32 is inputted to the vehicle body controller 14, which identifies a pump load of the hydraulic excavator.

The vehicle body controller 14 calculates an operation-based target pump flow rate depending on the engine rotational speed and the input signals from the operation pressure sensors 29 through 31. Further, the vehicle body controller 14 calculates a limited horsepower (KW) depending on the engine rotational speed, the operation situation, and other vehicle body states (temperature, etc.), and calculates an upper limit pump flow rate due to the limiting of the horsepower from the input signal from the pump delivery pressure sensor 32 and the limited horsepower. The vehicle body controller 14 selects a smaller one of the operation-based target pump flow rate and the upper limit pump flow rate due to the limiting of the horsepower, as a target pump flow rate, and actuates the pump flow rate control solenoid valve so as to achieve the target pump flow rate.

(Description of a System Configuration; Part of the Configuration as a Peripheral Detection and Operation Limiting System as a Premise)

The cabin 4 of the hydraulic excavator houses therein a periphery detection monitor 18 for indicating to the operator information detected by the 3D sensors 6 through 9 and a state of vehicle body operation limitation based on peripheral detection.

The 3D sensors 6 through 9, the periphery detection monitor 18, and the vehicle body controller 14 are connected to each other by CAN communication, and send and receive necessary information.

The CAN communication makes it possible for the vehicle body controller 14 and the periphery detection monitor 18 to learn whether an obstacle has been detected in each of the detection areas 10 through 13. Further, in a case where an obstacle (a person or an object) is present in one or more of the detection areas 10 through 13 created by the 3D sensors 6 through 9 as the obstacle sensors, the vehicle body controller 14 determines obstacle detection. In a case where an obstacle (a person or an object) is not present in any of the detection areas 10 through 13, the vehicle body controller 14 determines obstacle non-detection.

A swing pilot pressure interruption solenoid valve 34 is included as a vehicle body operation limiting device in the pilot circuit between the swing operation lever 19 and the control valve 25.

The swing pilot pressure interruption solenoid valve 34 is in a circuit fluid communication state when not controlled (0 mA). As an electric current (mA) outputted from the vehicle body controller 14 to the swing pilot pressure interruption solenoid valve 34 increases, the swing pilot pressure interruption solenoid valve 34 is brought into a circuit interruption state, making the upper swing structure 2 impossible to swing.

Moreover, a travel pilot pressure interruption solenoid valve 35 is included as a vehicle body operation limiting device in the pilot circuit between the travel operation lever 20 and the control valve 25.

The travel pilot pressure interruption solenoid valve 35 is in a circuit fluid communication state when not controlled (0 mA). As an electric current (mA) outputted from the vehicle body controller 14 to the travel pilot pressure interruption solenoid valve 35 increases, the travel pilot pressure interruption solenoid valve 35 is brought into a circuit interruption state, making the lower track structure 1 impossible to travel.

(Description of a System Configuration; Additional Aspect According to the Present Invention)

According to the present embodiment, the cabin 4 houses therein a control canceling switch 36 including a momentary pushbutton switch as a control canceling device.

When the control canceling switch 36 is not pressed, the control canceling switch 36 is OFF (its terminals are open or disconnected). When the control canceling switch 36 is pressed, the control canceling switch 36 is ON (its terminals are connected). The vehicle body controller 14 monitors an ON/OFF state of the control canceling switch 36 to recognize whether the control canceling switch 36 is pressed or not.

The control canceling switch 36 may be provided as one of grip switches on the operation levers 19 through 21 or may be provided as an individual switch positioned in a location different from that of the operation levers 19 through 21.

If the control canceling switch 36 is provided as an individual switch, then the operator is required to take his/her hands off the operation levers to press the control canceling switch 36. In a case where the operator is to press the control canceling switch 36 while the vehicle body is in operation, the operator is required to temporarily interrupt work. The individual switch is more effective in that it prompts the operator to check the periphery before pressing the control canceling switch 36.

(Description of a Controller Makeup)

Figure 4:
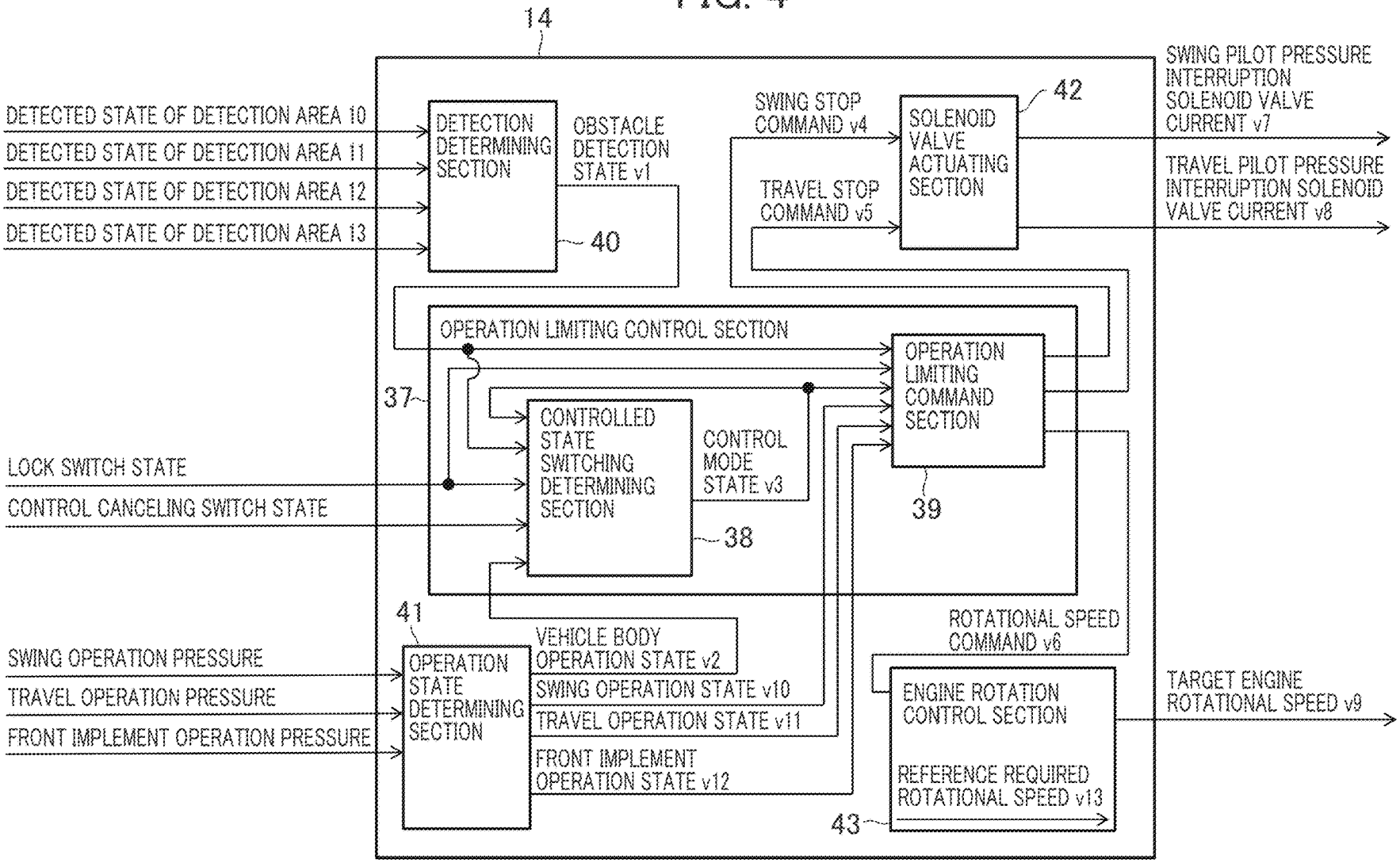
FIG. 4 is a diagram illustrating the makeup of a controller for limiting operation of a vehicle body upon detection of an obstacle according to the first embodiment of the present invention.

FIG. 4 is a diagram illustrating the makeup of the controller 14 for limiting operation of the vehicle body upon detection of an obstacle.

The vehicle body controller 14 has an operation limiting control section 37 as a control section for limiting operation of the vehicle body upon detection of an obstacle.

The operation limiting control section 37 includes a controlled state switching determining section 38 as a control section for determining whether a control mode state of the vehicle body is a normal state, a temporary cancelation state, or a permanent cancelation state.

The operation limiting control section 37 also includes an operation limiting command section 39 as a control section for commanding the operation limiting device to work.

The vehicle body controller 14 has, other than the operation limiting control section 37, a detection determining section 40 for determining whether there is an obstacle in the periphery of the vehicle body or not from detected states of the detection areas 10 through 13, an operation state determining section 41 for determining whether the vehicle body is in an operation/non-operation state from the magnitudes of operation pressures converted into pressure values (MPa) depending on input voltages from the operation pressure sensors 29 through 31 in the vehicle body controller 14, a solenoid valve actuating section 42 for calculating an electric current value for actuating the swing pilot pressure interruption solenoid valve 34 or the travel pilot pressure interruption solenoid valve 35 in response to a swing stop command or a travel stop command from the operation limiting command section 39, and an engine rotation control section 43 for limiting a target engine rotational speed to be given to the engine controller 23 in response to a rotational speed command from the operation limiting command section 39.

Processing sequences of these control sections are executed at all times in each of control periods of the vehicle body controller 14 after the engine has started and a periphery detection system has started (while the periphery detection system is in operation).

(Description of Details of the Control Sections)

Details of the control sections illustrated in FIG. 4 will be described below with reference to FIGS. 5 through 14.

(Description of Details of the Control Sections; the Detection Determining Section)

Figure 5:
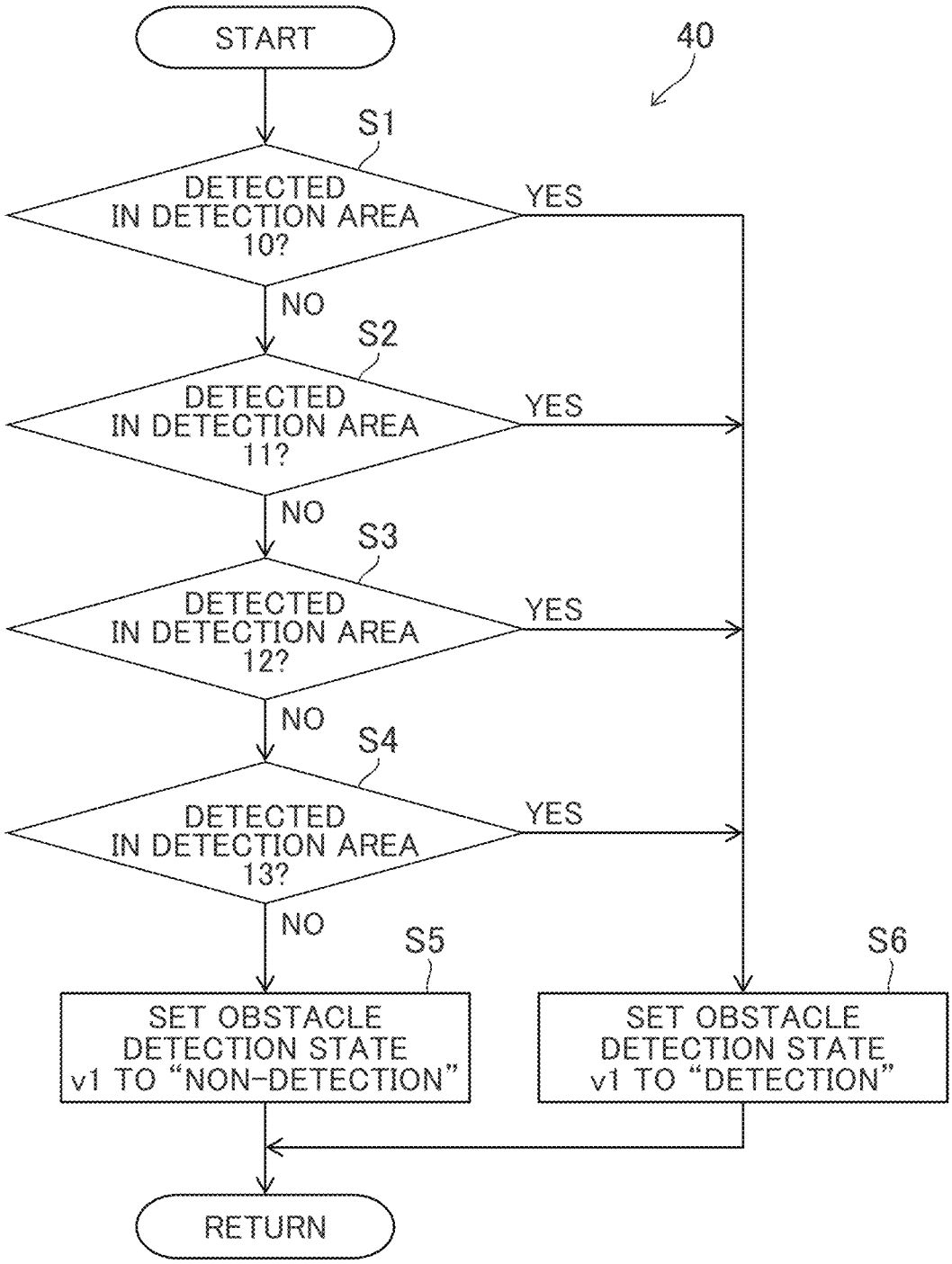
FIG. 5 is a flowchart of a processing sequence of a detection determining section according to the first embodiment of the present invention.

FIG. 5 is a flowchart of a processing sequence of the detection determining section 40.

First, the detection determining section 40 determines whether the 3D sensor 6 has detected an item (a person or an object) in the detection area 10 or not (step S1). If the 3D sensor 6 has detected an item in the detection area 10, then the detection determining section 40 determines that the vehicle body is in a detection state, and sets an obstacle detection state v1 that is a variable to "detection" (step S6).

If the 3D sensor 6 has not detected an item in the detection area 10, then the detection determining section 40 determines whether the 3D sensor 7 has detected an item in the detection area 11 or not (step S2). If the 3D sensor 7 has detected an item in the detection area 11, then the detection determining section 40 determines that the vehicle body is in a detection state, and sets the obstacle detection state v1 that is a variable to "detection" (step S6).

If the 3D sensor 7 has not detected an item in the detection area 11, then the detection determining section 40 determines whether the 3D sensor 8 has detected an item in the detection area 12 or not (step S3). If the 3D sensor 8 has detected an item in the detection area 12, then the detection determining section 40 determines that the vehicle body is in a detection state, and sets the obstacle detection state v1 that is a variable to "detection" (step S6).

If the 3D sensor 8 has not detected an item in the detection area 12, then the detection determining section 40 determines whether the 3D sensor 9 has detected an item in the detection area 13 or not (step S4). If the 3D sensor 9 has detected an item in the detection area 13, then the detection determining section 40 determines that the vehicle body is in a detection state, and sets the obstacle detection state v1 that is a variable to "detection" (step S6).

If an item has not been detected in any of the detection areas 10 through 13, then the detection determining section 40 determines that the vehicle body is in a non-detection state, and sets the obstacle detection state v1 that is a variable to "non-detection" (step S5).

(Description of Details of the Control Sections; the Operation State Determining Section)

Figure 6:
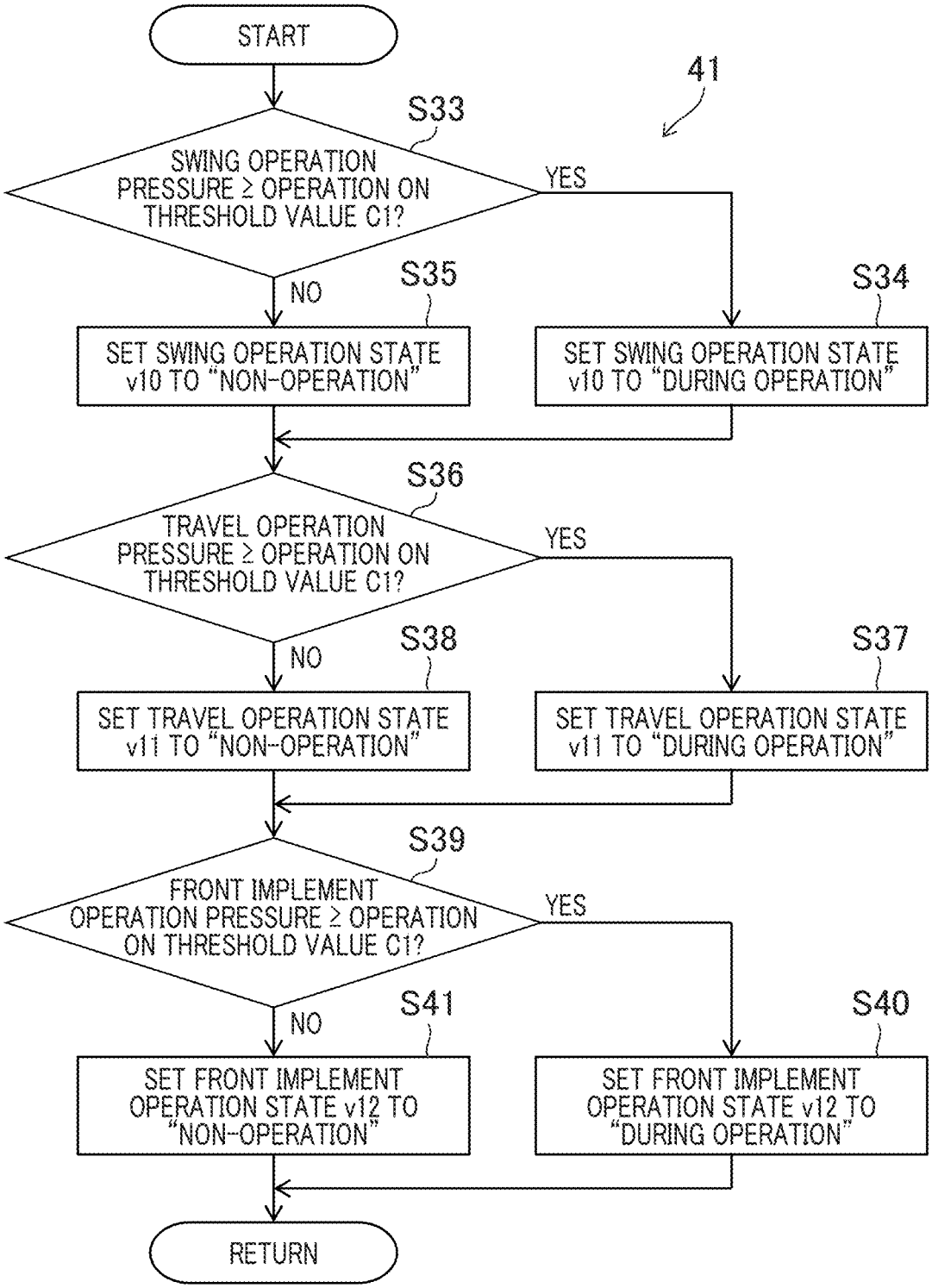
FIG. 6 is a flowchart of a portion for determining an operation state with respect to each event of operation, of a processing sequence of an operation state determining section according to the first embodiment of the present invention.

FIG. 6 is a flowchart of a portion for determining an operation state with respect to each event of operation, of a processing sequence of the operation state determining section 41.

First, the operation state determining section 41 determines whether or not a swing operation pressure is equal to or higher than an operation ON threshold value C1 (e.g., 0.5 MPa) (step S33). If the swing operation pressure is equal to or higher than the operation ON threshold value C1, then the operation state determining section 41 determines that a swing operation is performed, and sets a swing operation state v10 that is a variable to "during operation" (step S34). If the swing operation pressure is lower than the operation ON threshold value C1, then the operation state determining section 41 determines that a swing operation is not performed, and sets the swing operation state v10 that is a variable to "non-operation" (step S35).

Next, the operation state determining section 41 determines whether or not a travel operation pressure is equal to or higher than the operation ON threshold value C1 (e.g., 0.5 MPa) (step S36). If the travel operation pressure is equal to or higher than the operation ON threshold value C1, then the operation state determining section 41 determines that a travel operation is performed, and sets a travel operation state v11 that is a variable to "during operation" (step S37). If the travel operation pressure is lower than the operation ON threshold value C1, then the operation state determining section 41 determines that the travel operation is not performed, and sets the travel operation state v11 that is a variable to "non-operation" (step S38).

Then, the operation state determining section 41 determines whether or not a front implement operation pressure is equal to or higher than the operation ON threshold value C1 (e.g., 0.5 MPa) (step S39). If the front implement operation pressure is equal to or higher than the operation ON threshold value C1, then the operation state determining section 41 determines that the front implement is operated, and sets a front implement operation state v12 that is a variable to "during operation" (step S40). If the front implement operation pressure is lower than the operation ON threshold value C1, then the operation state determining section 41 determines that the front implement is not operated, and sets the front implement operation state v12 that is a variable to "non-operation" (step S41).

Figure 7:
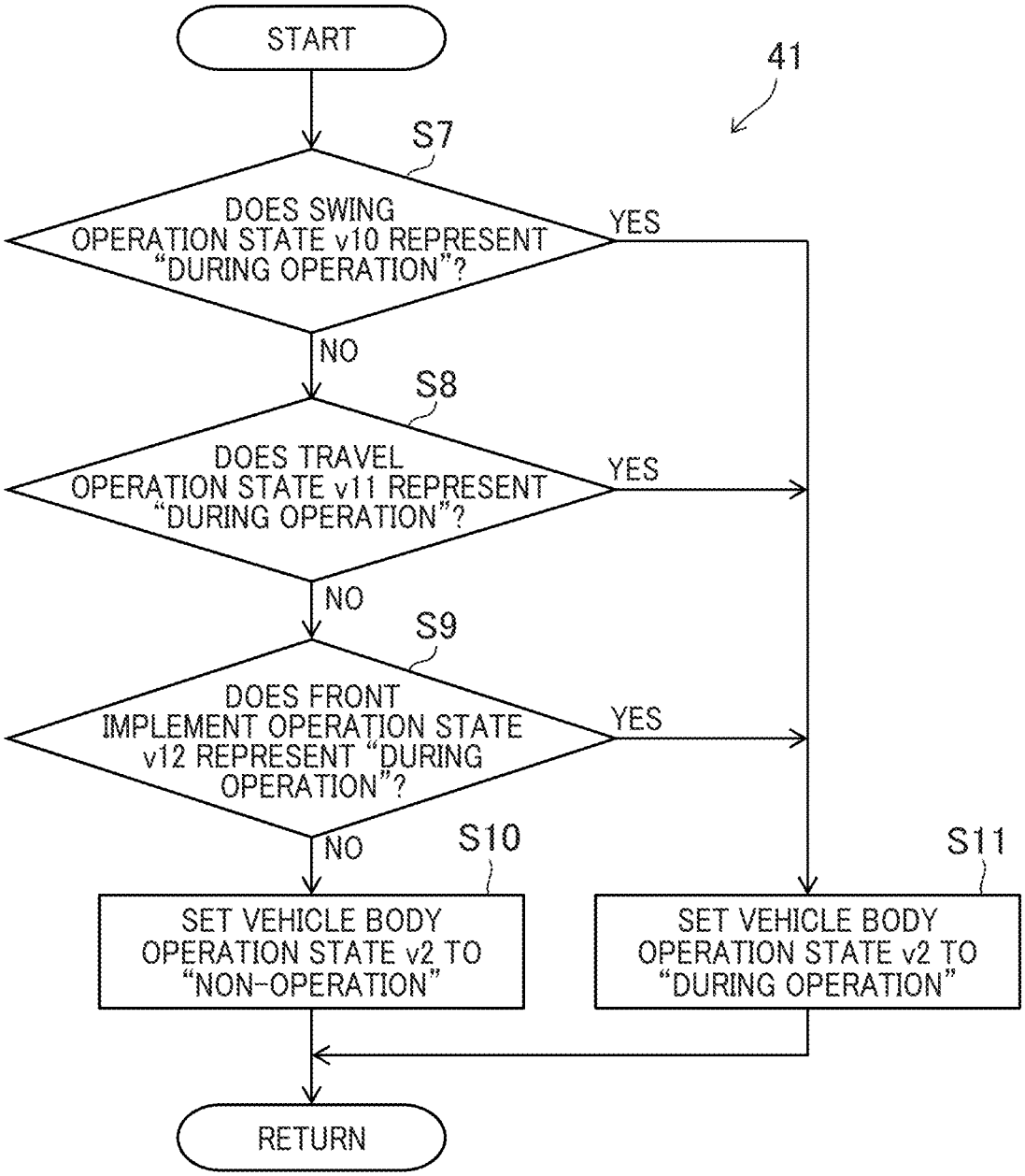
FIG. 7 is a flowchart of a portion for determining an operated state with respect to the vehicle body, of the processing sequence of the operation state determining section according to the first embodiment of the present invention.

FIG. 7 is a flowchart of a portion for determining an operation state with respect to the vehicle body, of the processing sequence of the operation state determining section 41.

First, the operation state determining section 41 determines whether the swing operation state v10 represents "during operation" or not (step S7). If the swing operation state v10 represents "during operation," then the operation state determining section 41 determines that the vehicle body is in an operation state, and sets a vehicle body operation state v2 that is a variable to "during operation" (step S11).

If the swing operation state v10 does not represent "during operation" (if the swing operation state v10 represents "non-operation"), then the operation state determining section 41 determines whether the travel operation state v11 represents "during operation" or not (step S8). If the travel operation state v11 represents "during operation," then the operation state determining section 41 determines that the vehicle body is in an operation state, and sets the vehicle body operation state v2 that is a variable to "during operation" (step S11).

If the travel operation state v11 does not represent "during operation" (if the travel operation state v11 represents "non-operation"), then the operation state determining section 41 determines whether the front implement operation state v12 represents "during operation" or not (step S9). If the front implement operation state v12 represents "during operation," then the operation state determining section 41 determines that the vehicle body is in an operation state, and sets the vehicle body operation state v2 that is a variable to "during operation" (step S11).

If all of the swing operation state v10, the travel operation state v11, and the front implement operation state v12 do not represent "during operation" (if all of the swing operation state v10, the travel operation state v11, and the front implement operation state v12 represent "non-operation"), then the operation state determining section 41 determines that the vehicle body is in a non-operation state, and sets the vehicle body operation state v2 that is a variable to "non-operation" (step S10).

(Description of Details of the Control Sections; the Controlled State Switching Determining Section)

Figure 8:
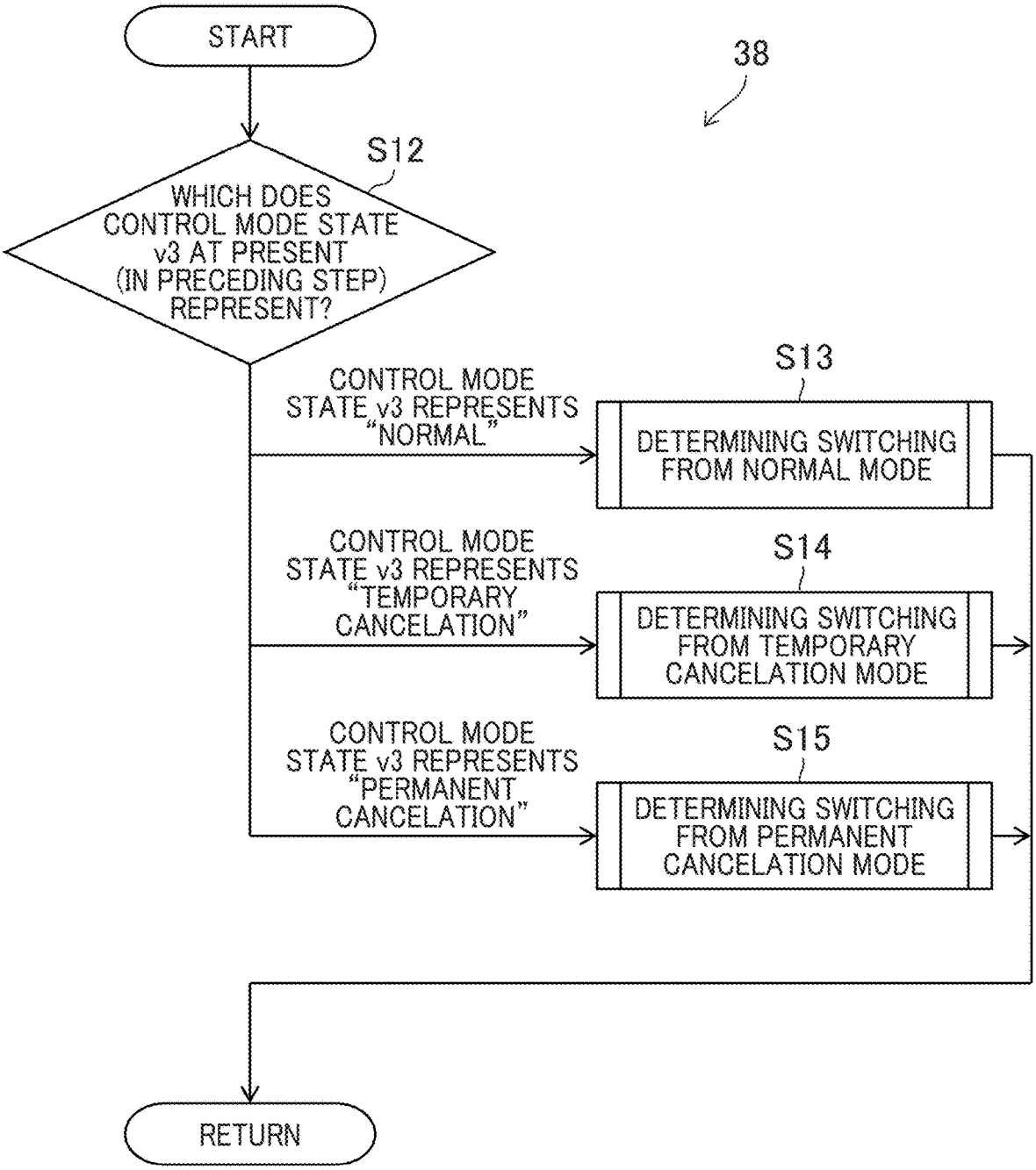
FIG. 8 is a flowchart of an entire processing sequence of a controlled state switching determining section according to the first embodiment of the present invention.

FIG. 8 is a flowchart of an entire processing sequence of the controlled state switching determining section 38.

The controlled state switching determining section 38 selects a processing sequence to be carried out depending on whether a control mode state v3 at present (in a preceding step of the control sequence) represents "normal," "temporary cancelation," or "permanent cancelation" (step S12).

If the control mode state v3 at present represents "normal," then the controlled state switching determining section 38 carries out a process of determining switching from a normal mode (step S13). If the control mode state v3 at present represents "temporary cancelation," then the controlled state switching determining section 38 carries out a process of determining switching from a temporary cancelation mode (step S14). If the control mode state v3 at present represents "permanent cancelation," then the controlled state switching determining section 38 carries out a process of determining switching from a permanent cancelation mode (step S15).

The control mode state v3 has a default value representing "normal." When the engine is started next time after the key has once been turned off, the processing sequence always begins with the control mode state v3 representing "normal."

Figure 9:
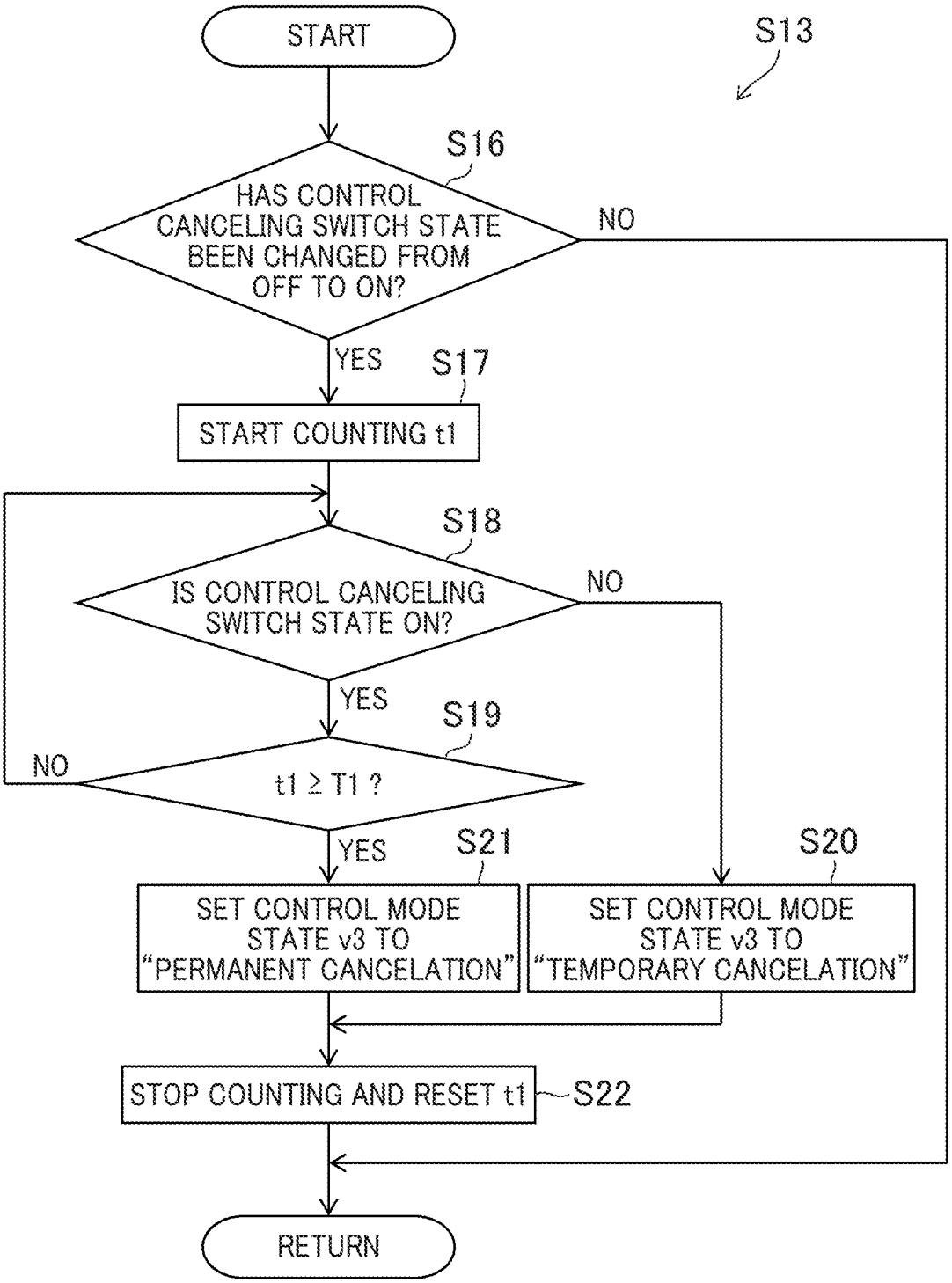
FIG. 9 is a flowchart of a processing sequence of a process of determining switching from a normal mode, as a subroutine of the controlled state switching determining section according to the first embodiment of the present invention.

FIG. 9 is a flowchart of a processing sequence of the process of determining switching from the normal mode (step S13), as a subroutine of the controlled state switching determining section 38.

The vehicle body controller 14 determines whether the control canceling switch 36 is pressed or not by checking whether the terminals of the control canceling switch 36 are disconnected or connected. According to the present embodiment, if the control canceling switch 36 is pressed, then the vehicle body controller 14 determines that a control canceling switch state is "ON," and if the control canceling switch 36 is not pressed, then the vehicle body controller 14 determines that the control canceling switch state is "OFF."

In the determination of switching from the normal mode (step S13), first, the controlled state switching determining section 38 determines whether the control canceling switch state has changed from OFF to ON (whether the control canceling switch 36 has changed from a non-pressed state to a pressed state or not) (step S16).

If the controlled state switching determining section 38 determines that the answer to step S16 is NO, then, since the control canceling switch 36 is not pressed, the controlled state switching determining section 38 puts an end to the processing sequence without switching the control mode state v3 from "normal."

If the control canceling switch 36 is pressed and the control canceling switch state has changed from OFF to ON, the controlled state switching determining section 38 starts counting a control canceling switch ON time t1 (step S17).

Then, the controlled state switching determining section 38 determines whether the control canceling switch state is ON or not (whether the control canceling switch 36 is pressed or not) (step S18). If the control canceling switch state is ON, then the controlled state switching determining section 38 determines whether or not the control canceling switch ON time t1 is equal to or longer than a cancelation mode determining time T1 (e.g., 2 seconds) (step S19). If the control canceling switch ON time t1 is shorter than the cancelation mode determining time T1, then the processing sequence goes back to step S18 and is repeated.

If the controlled state switching determining section 38 determines that the control canceling switch state is not ON in step S18, i.e., if the pushbutton of the control canceling switch 36 is pressed for such a short period of time that the control canceling switch 36 is no longer pressed by the time the control canceling switch ON time t1 reaches the cancelation mode determining time T1, then the controlled state switching determining section 38 switches the control mode state v3 to "temporary cancelation" (step S20).

If the control canceling switch ON time t1 becomes equal to or longer than the cancelation mode determining time T1 with the control canceling switch state being ON, i.e., if the pushbutton of the control canceling switch 36 is pressed for such a long period of time that the control canceling switch 36 is continuously pressed until the control canceling switch ON time t1 reaches the cancelation mode determining time T1, then the controlled state switching determining section 38 switches the control mode state v3 to "permanent cancelation" (step S21).

After having switched the control mode state v3 from "normal" in step S20 or step S21, the controlled state switching determining section 38 stops counting the control canceling switch ON time t1 and resets the control canceling switch ON time t1 to a default value (0) (step S22).

Figure 10:
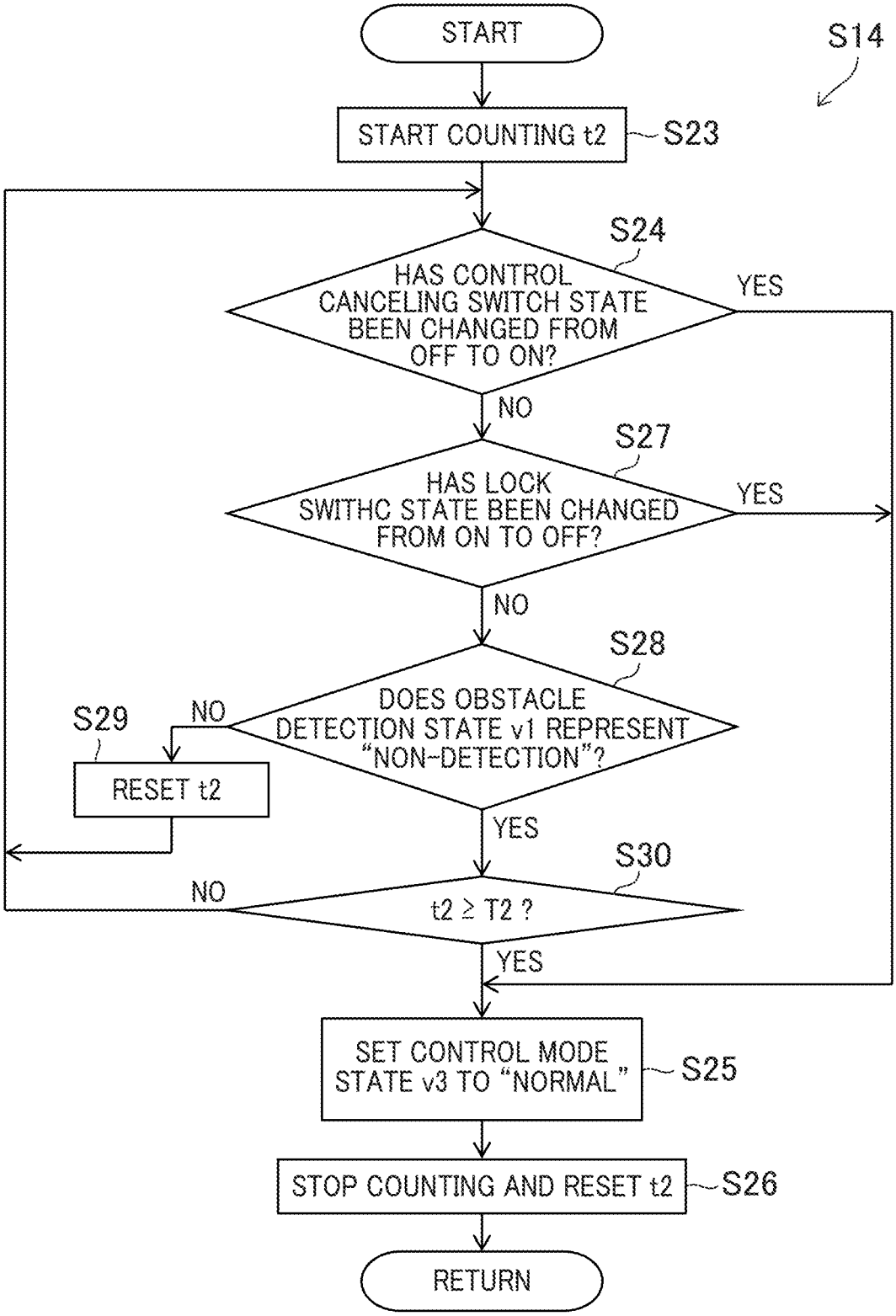
FIG. 10 is a flowchart of a processing sequence of a process of determining switching from a temporary cancelation mode, as a subroutine of the controlled state switching determining section according to the first embodiment of the present invention.

FIG. 10 is a flowchart of a processing sequence of the process of determining switching from the temporary cancelation mode (step S14), as a subroutine of the controlled state switching determining section 38.

The vehicle body controller 14 determines whether the lock switch 15 is pressed or not by checking whether the terminals of the lock switch 15 are disconnected or connected.

According to the present embodiment, when the lock lever disposed in the cabin 4 is in the locked position and the lock switch 15 is not pressed, a lock switch state is "OFF." When the lock switch state is OFF, the vehicle body controller 14 de-energizes the lock valve 28 into the interruption position, disabling the vehicle body operationally in whole.

According to the present embodiment, further, when the lock lever disposed in the cabin 4 is in the unlocked position and the lock switch 15 is pressed, the lock switch state is "ON." When the lock switch state is ON, the vehicle body controller 14 applies 24 V to the lock valve 28 to energize the lock valve 28 into the fluid communication position, enabling the vehicle body to be operational.

In the process of determining switching from the temporary cancelation mode (step S14), first, the controlled state switching determining section 38 starts counting a non-detection time t2 (step S23).

Then, the controlled state switching determining section 38 determines whether the control canceling switch state has changed from OFF to ON or not (whether the switch has changed from a non-pressed state to a pressed state or not) (step S24).

If the controlled state switching determining section 38 determines that the answer to step S24 is YES, then the controlled state switching determining section 38 switches the control mode state v3 to "normal" (step S25). Thereafter, the controlled state switching determining section 38 stops counting the non-detection time t2 and resets the non-detection time t2 to a default value (0) (step S26), after which the processing sequence is ended.

If the control canceling switch 36 is not pressed and the control canceling switch state remains to be OFF, then the controlled state switching determining section 38 determines whether the lock switch state has changed from ON to OFF or not (whether the lock lever has shifted from the unlocked position to the locked position or not) (step S27).

If the controlled state switching determining section 38 determines that the answer to step S27 is YES, then the controlled state switching determining section 38 switches the control mode state v3 to "normal" (step S25). Thereafter, the controlled state switching determining section 38 stops counting the non-detection time t2 and resets the non-detection time t2 to the default value (0) (step S26), after which the processing sequence is ended.

If the lock switch 15 is not in the locked position and the lock switch state remains to be ON, then the controlled state switching determining section 38 determines whether the obstacle detection state v1 represents "non-detection" or not (step S28). If the obstacle detection state v1 does not represent "non-detection," i.e., if the obstacle detection state v1 represents "detection" where the 3D sensors 6 through 9 have detected one or more obstacles, then the controlled state switching determining section 38 does not switch the control mode state v3 from "temporary cancelation," and resets the non-detection time t2 to the default value (0) (step S29). The processing sequence goes back to step S24, and the determining process is continued.

If the obstacle detection state v1 represents "non-detection" in step S28, then the controlled state switching determining section 38 determines whether or not the non-detection time t2 is equal to or longer than a control mode return time T2 (e.g., 30 seconds) (step S30). If the non-detection time t2 is shorter than the control mode return time T2, then the processing sequence goes back to step S24, and the determining process is continued.

If the non-detection time t2 becomes equal to or longer than the control mode return time T2 without detecting an obstacle, then the controlled state switching determining section 38 switches the control mode state v3 to "normal" (step S25). Thereafter, the controlled state switching determining section 38 stops counting the non-detection time t2 and resets the non-detection time t2 to the default value (0) (step S26), after which the processing sequence is ended.

Figure 11:
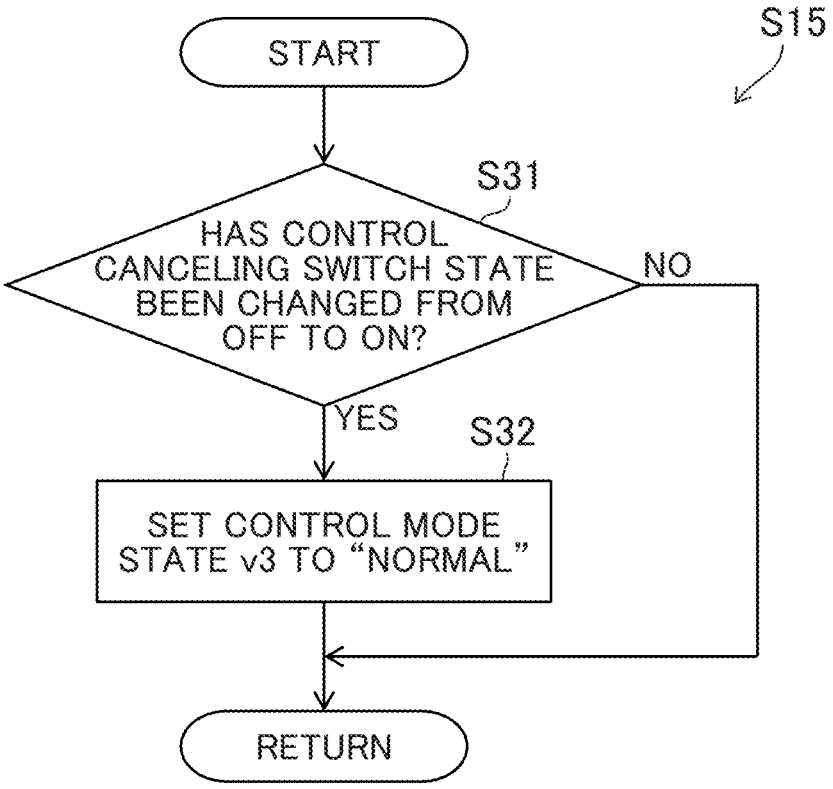
FIG. 11 is a flowchart of a processing sequence of a process of determining switching from a permanent cancelation mode, as a subroutine of the controlled state switching determining section according to the first embodiment of the present invention.

FIG. 11 is a flowchart of a processing sequence of a process of determining switching from the permanent cancelation mode (step S15), as a subroutine of the controlled state switching determining section 38.

In step S15, the controlled state switching determining section 38 determines whether the control canceling switch state has changed from OFF to ON or not (whether the control canceling switch 36 has changed from the non-pressed state to the pressed state or not) (step S31).

If the controlled state switching determining section 38 determines that the answer to step S31 is YES, then the controlled state switching determining section 38 switches the control mode state v3 to "normal" (step S32), after which the processing sequence is ended. If the control canceling switch 36 is not pressed and the control canceling switch state remains to be OFF, then the controlled state switching determining section 38 does not switch the control mode state v3 from "permanent cancelation," after which the processing sequence is ended.

(Description of Details of the Control Sections; the Operation Limiting Command Section)

Figure 12:
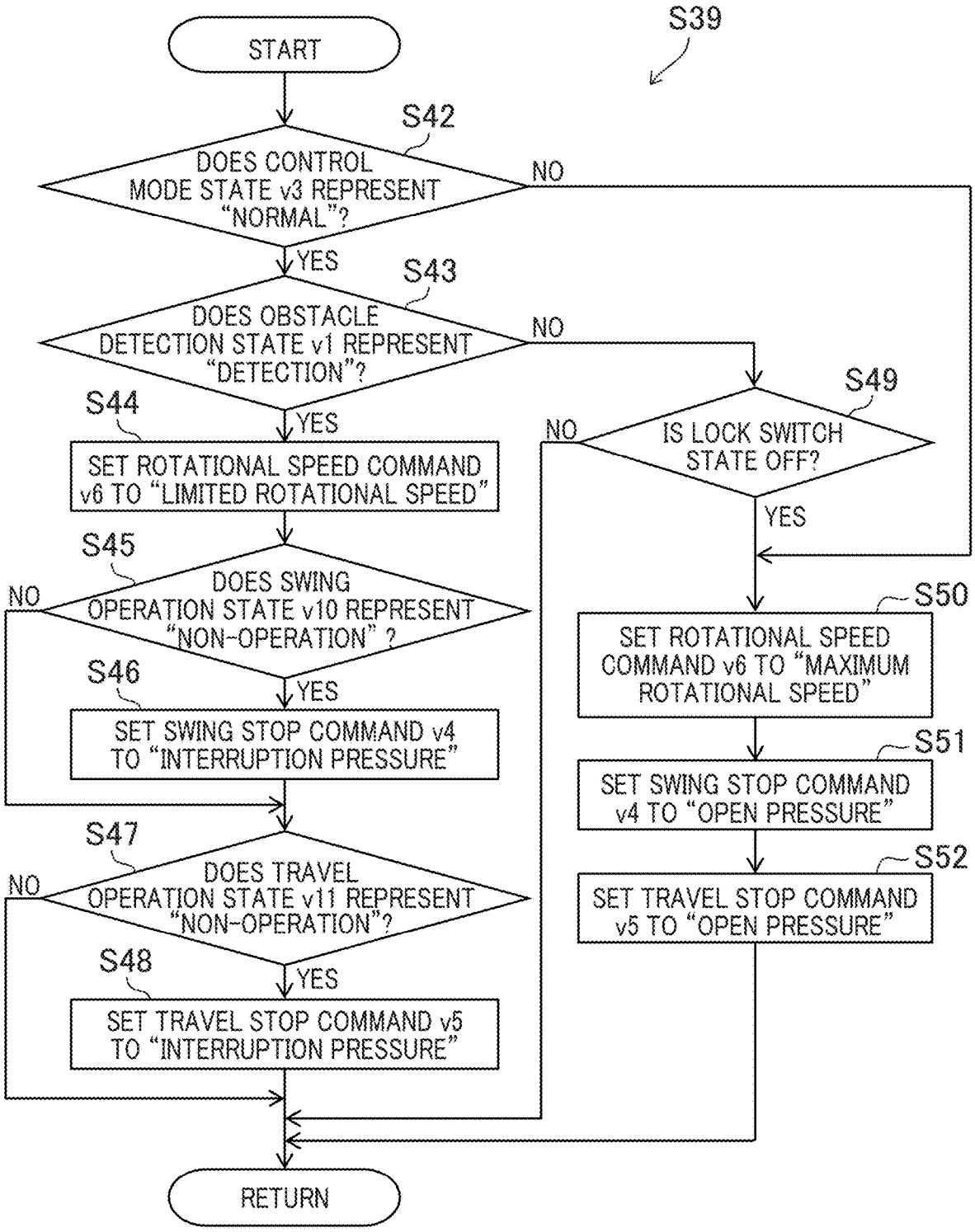
FIG. 12 is a flowchart of a processing sequence of an operation limiting commanding section according to the first embodiment of the present invention.

FIG. 12 is a flowchart of a processing sequence of the operation limiting command section 39.

First, the operation limiting command section 39 determines whether the control mode state v3 represents "normal" or not (step S42). If the control mode state v3 represents "normal" (if the control mode state v3 does not represent "temporary cancelation" or "permanent cancelation"), then the operation limiting command section 39 determines whether the obstacle detection state v1 represents "detection" or not (step S43). If there is an item (a person or an object) in the periphery of the vehicle body and the obstacle detection state v1 represents "detection," then the operation limiting command section 39 sets a rotational speed command v6 to "limited rotational speed" (e.g., 800 rpm) (step S44).

In this manner, the engine rotational speed of the vehicle body is limited to a low value through the processing of the engine rotation control section 43 to be described later. When the vehicle body has been operating at a high engine rotational speed (e.g., 1800 rpm) during normal work, as the engine rotational speed is lowered upon obstacle detection, the operator can notice the detection through a bodily sensation in addition to a warning or display, so that higher safety can be achieved.

Further, while an obstacle is being detected, since the engine rotational speed is limited and the same work cannot be continued as it is by ignoring the obstacle detection, the operator is prompted to stop the work and check safety in the periphery.

Then, the operation limiting command section 39 determines whether the swing operation state v10 represents "non-operation" or not (step S45). If the swing operation state v10 represents "non-operation" where no swing operation is performed while an obstacle is being detected, the operation limiting command section 39 sets a swing stop command v4 to "interruption pressure" (e.g., 0 MPa) (step S46).

In this fashion, swing operation is made impossible through the processing of the solenoid valve actuating section 42 to be described later. By stopping a swinging start while an obstacle is present in the periphery of the vehicle body, it is possible to lower the possibility of an accident due to contact between the vehicle body and a peripheral worker when the hydraulic excavator is about to move.

Next, the operation limiting command section 39 determines whether the travel operation state v11 represents "non-operation" or not (step S47). If the travel operation state v11 represents "non-operation" where no travel operation is performed while an obstacle is being detected, the operation limiting command section 39 sets a travel stop command v5 to "interruption pressure" (e.g., 0 MPa) (step S48).

In this fashion, travel operation is made impossible through the processing of the solenoid valve actuating section 42 to be described later. By stopping a traveling start while an obstacle is present in the periphery of the vehicle body, it is possible to lower the possibility of an accident due to contact between the vehicle body and a peripheral worker when the hydraulic excavator is about to move.

As described above, upon obstacle detection, vehicle body operation limitation for limiting vehicle body operation is enabled.

Next, a process of determining cancelation of the vehicle body operation limitation and a control process will be described below.

If an item (a person or an object) is not detected in the periphery of the vehicle body and the obstacle detection state v1 does not represent "detection" in step S43 (the obstacle detection state v1 represents "non-detection" in step S43), the operation limiting command section 39 determines whether the lock switch state is OFF or not (step S49). If the lock lever is in the locked position and the lock switch state is OFF while no obstacle is being detected, the operation limiting command section 39 sets the rotational speed command v6 to "maximum rotational speed" (e.g., 2000 rpm) (step S50), sets the swing stop command v4 to "open pressure" (e.g., 4 MPa) (step S51), and sets the travel stop command v5 to "open pressure" (e.g., 4 MPa) (step S52).

If the lock lever is in the unlocked position and the lock switch state is ON (the lock switch state is not OFF), the vehicle body operation limitation remains enabled even if the obstacle detection state v1 no longer represents "detection."

Since the lock valve 28 is in the interruption position while the lock lever is in the locked position, the vehicle body is operationally disabled in whole. By permitting the vehicle body operation limitation to be canceled only in this state, it is possible to avoid a situation where swinging/traveling operation is canceled and the vehicle body is allowed to move abruptly when no obstacle is detected while the operator has unintentionally moved down the operation levers 19 and 20, for example, resulting in higher safety.

(Description of Details of the Control Sections; the Solenoid Valve Actuating Section)

Figure 13:
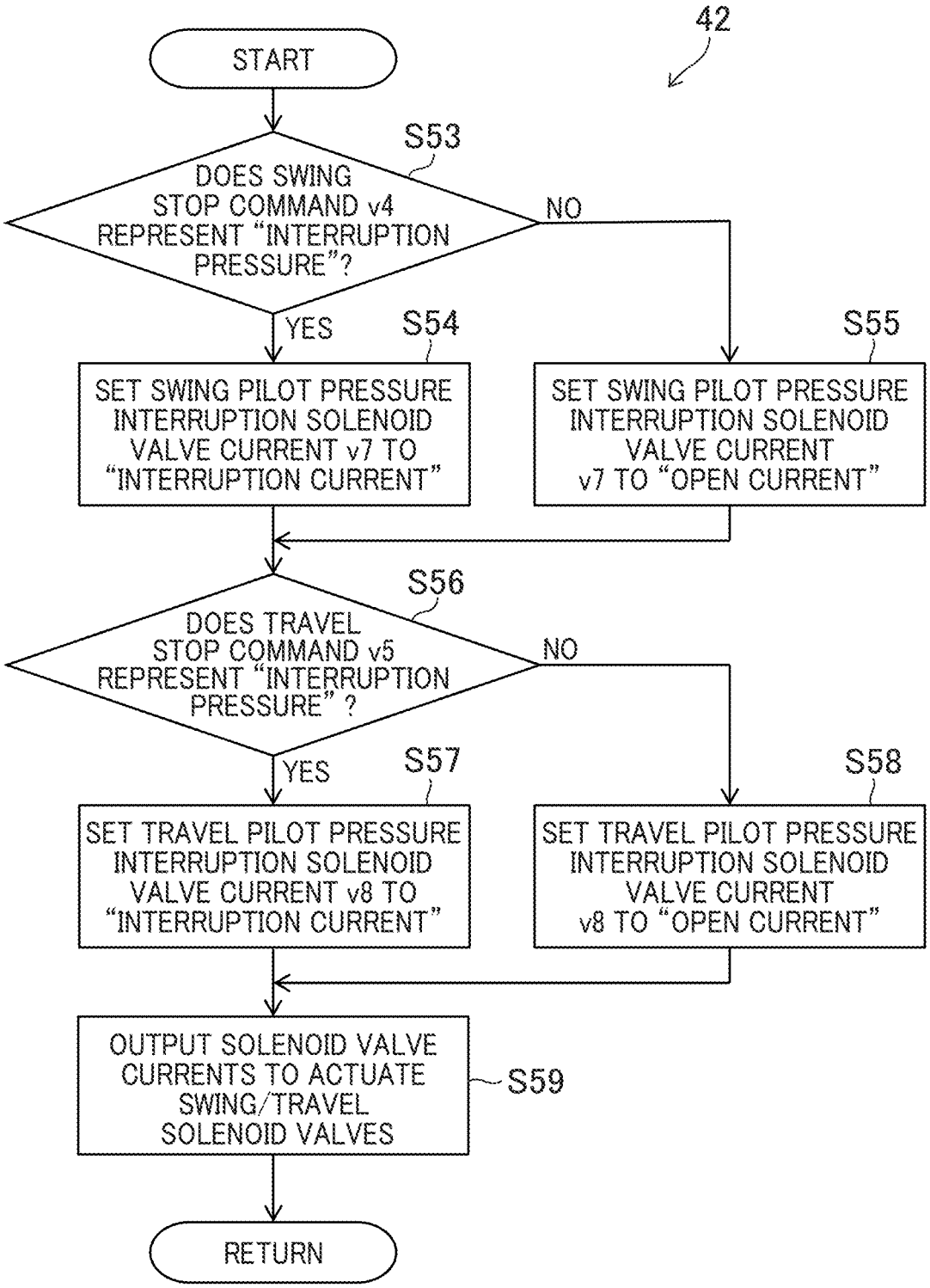
FIG. 13 is a flowchart of a processing sequence of a solenoid valve actuating section according to the first embodiment of the present invention.

FIG. 13 is a flowchart of a processing sequence of the solenoid valve actuating section 42.

The solenoid valve actuating section 42 is a control section for actually actuating the swing pilot pressure interruption solenoid valve 34 and the travel pilot pressure interruption solenoid valve 35 as the vehicle body operation limiting devices according to solenoid valve pressures represented by the swing stop command v4 and the travel stop command v5 as calculated results from the operation limiting command section 39.

First, the solenoid valve actuating section 42 determines whether the swing stop command v4 represents "interruption pressure" or not (step S53). If the swing stop command v4 represents "interruption pressure," then the solenoid valve actuating section 42 sets a swing pilot pressure interruption solenoid valve current v7 to "interruption current" (e.g., 600 mA) (step S54). If the swing stop command v4 does not represent "interruption pressure" (if the swing stop command v4 represents "open pressure"), then the solenoid valve actuating section 42 sets the swing pilot pressure interruption solenoid valve current v7 to "open current" (e.g., 0 mA) (step S55).

Then, the solenoid valve actuating section 42 determines whether the travel stop command v5 represents "interruption pressure" or not (step S56). If the travel stop command v5 represents "interruption pressure," then the solenoid valve actuating section 42 sets a travel pilot pressure interruption solenoid valve current v8 to "interruption current" (e.g., 600 mA) (step S57). If the travel stop command v5 does not represent "interruption pressure" (if the travel stop command v5 represents "open pressure"), then the solenoid valve actuating section 42 sets the travel pilot pressure interruption solenoid valve current v8 to "open current" (e.g., 0 mA) (step S58).

The vehicle body controller 14 incorporates therein a solenoid valve driver as an analog output circuit for actuating the solenoid of a proportional solenoid valve. The vehicle body controller 14 supplies an electric current to the analog output circuit to generate the swing pilot pressure interruption solenoid valve current v7 and the travel pilot pressure interruption solenoid valve current v8, thereby actuating the swing pilot pressure interruption solenoid valve 34 and the travel pilot pressure interruption solenoid valve 35 (step S59).

(Description of Details of the Control Sections; the Engine Rotation Control Section)

Figure 14:
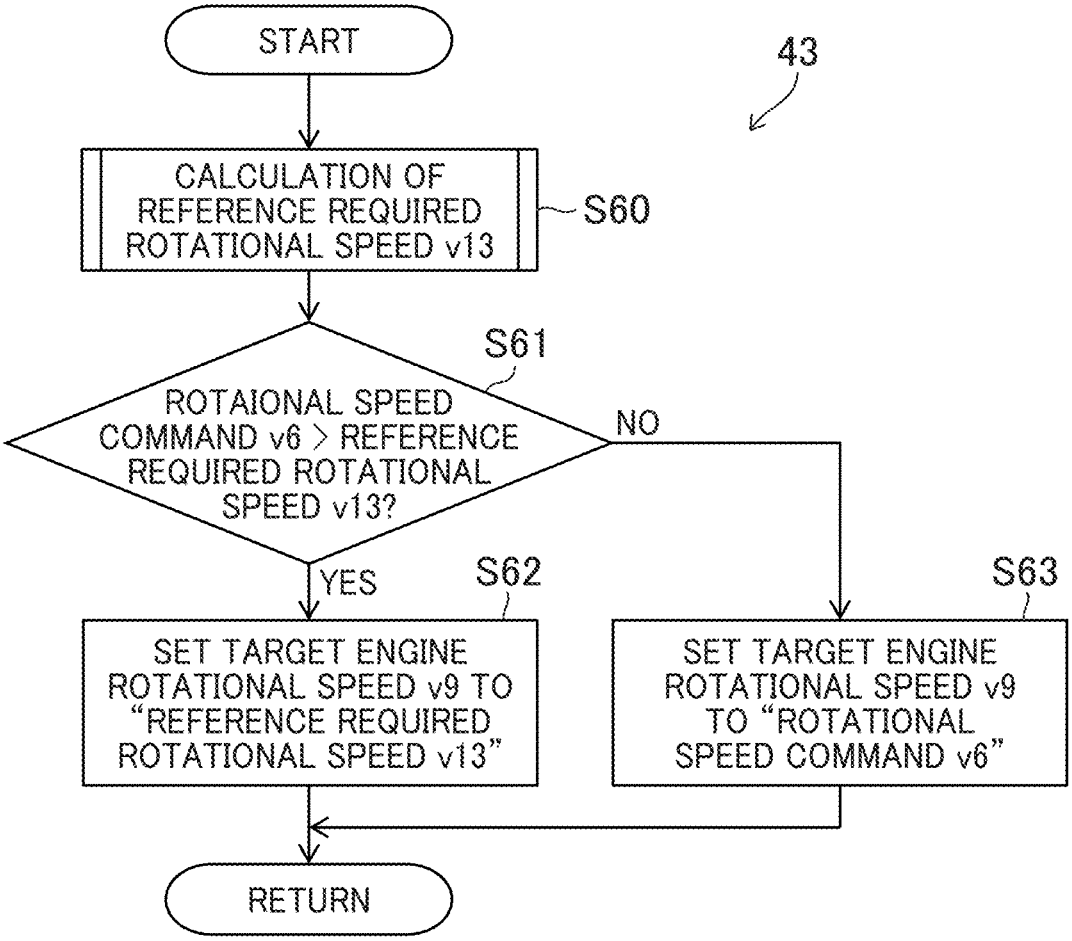
FIG. 14 is a flowchart of a processing sequence of an engine rotation control section according to the first embodiment of the present invention.

FIG. 14 is a flowchart of a processing sequence of the engine rotation control section 43.

The engine rotation control section 43 selects, under predetermined conditions, a required rotational speed depending on the engine control dial voltage operated by the operator, a required rotational speed depending on the operation amount of the operation levers, or a required rotational speed depending on the operation environments including the radiator coolant temperature, the hydraulic operating fluid temperature, etc., and eventually sends the selected required rotational speed as a target engine rotational speed v9 through the CAN communication to the engine controller 23, thereby achieving an actual engine rotational speed required of the vehicle body.

Although not described in detail according to the present embodiment, a required rotational speed according to a processing sequence common with a conventional hydraulic excavator, other than the rotational speed command v6 sent from the operation limiting command section 39, is calculated as a reference required rotational speed v13 by a processing sequence not illustrated in FIG. 14 (step S60). The rotational speed command v6 and the reference required rotational speed v13 are compared with each other at a final stage of the processing sequence of the engine rotation control section 43.

Following the calculation of the reference required rotational speed v13 (step S60), the engine rotation control section 43 determines whether the rotational speed command v6 sent from the operation limiting command section 39 is larger than the reference required rotational speed v13 (step S61).

When vehicle body operation limitation is not enabled, since the rotational speed command v6 is "maximum rotational speed" (e.g., 2000 rpm) larger than the reference required rotational speed v13, the engine rotation control section 43 sets the target engine rotational speed v9 to "reference required rotational speed v13," thereby making the hydraulic excavator usable as an ordinary hydraulic excavator (step S62).

When vehicle body operation limitation is enabled, since the rotational speed command v6 is "limited rotational speed" (e.g., 800 rpm) equal to or smaller than the reference required rotational speed v13, the engine rotation control section 43 sets the target engine rotational speed v9 to "rotational speed command v6," thereby forcefully limiting the engine rotational speed to limit operation of the vehicle body (step S63).

Advantages of the First Embodiment

According to the present embodiment, a hydraulic excavator includes actuators 3*d* through 3*h*, operation devices (operation levers 19 through 21) for instructing the actuators 3*d* through 3*h* to operate, obstacle sensors (3D sensors 6 through 9) for detecting an obstacle in the periphery, a controller 14 for performing operation limiting control to limit operation of the actuators 3*d* through 3*h* in a case where the obstacle sensors (3D sensors 6 through 9) detect an obstacle, and a control canceling device (control canceling switch 36) for instructing the controller 14 to cancel the operation limiting control, in which the controller 14 is configured to have a normal mode as a control mode for making the operation limiting control effective and a temporary cancelation mode as a control mode for temporarily canceling the operation limiting control, switch to the temporary cancelation mode in response to operation of the control canceling device (control canceling switch 36) while in the normal mode, and switch back to the normal mode in a case where a predetermined condition not responsive to operation of the control canceling device (control canceling switch 36) is satisfied while in the temporary cancelation mode.

According to the present embodiment, when the vehicle body is about to start moving at work, after the operator has checked safety in the periphery, the operator operates the control canceling switch 36 to switch from the normal mode in which operation limitation is enabled to the temporary cancelation mode in which operation limitation is not enabled. Thus, even if an object required for work is present in the periphery of the vehicle body, it is possible for the hydraulic excavator to perform work as an ordinary hydraulic excavator. In addition, when the predetermined condition not responsive to operation of the control canceling switch 36 is satisfied in the temporary cancelation mode, the controller 14 returns to the normal mode independently of operation of the control canceling switch 36, making it possible to reduce the possibility of an accident due to contact between the construction machine and a worker in the periphery thereof.

Further, the hydraulic excavator according to the present embodiment further includes an operation lock device (lock valve 28) switchable between a locked position (interruption position) for inhibiting operation of the actuators 3*d* through 3*h* and an unlocked position (fluid communication position) for permitting operation of the actuators 3*d* through 3*h*, in which the predetermined condition includes switching of the operation lock device (lock valve 28) from the unlocked position (fluid communication position) to the locked position (interruption position).

With the above arrangement, inasmuch as the controller 14 returns from the temporary cancelation mode to the normal mode in a stage where work is interrupted and the lock lever is locked (the lock switch 15 is OFF), when the vehicle body is about to move next, a vehicle body operation limiting device works again due to obstacle detection, thereby increasing safety. Moreover, as the controller 14 returns from the temporary cancelation mode to the normal mode by operating the lock valve 28 (operation lock device) as performed on conventional construction machines, the controller 14 can return to the normal mode even if the operator forgets to take an operation action to return from the temporary cancelation mode, resulting in increased safety to lower the possibility of an accident due to contact between the construction machine that is about to move and a worker in the periphery.

According to the present embodiment, further, the predetermined condition includes the continuation of a state in which the obstacle sensors (3D sensors 6 through 9) do not detect an obstacle over a predetermined period of time (control mode return time T2).

With the above arrangement, since the controller 14 returns from the temporary cancelation mode to the normal mode when the control mode return time T2 (e.g., 30 seconds) has elapsed while the obstacle detection state v1 is representing "non-detection" even if the lock valve 28 (operation lock device) is not operated, the controller 14 can return to the normal mode even if the operator forgets to take an operation action to return from the temporary cancelation mode, resulting in increased safety to lower the possibility of an accident due to contact between the construction machine that is about to move and a worker in the periphery.

The control mode return time T2 is established taking into account operability and safety sufficiently in advance. For increased safety, the controller 14 should return from the temporary cancelation state to the normal state in as short a period of time as possible, which however may possibly reduce operability.

For example, while the hydraulic excavator is carrying out dump truck loading work including repeated actions of excavating, 90° swinging, soil dropping, and returning, it is assumed that a gravel mound to work on is to be detected as a peripheral obstacle only upon soil dropping. At this time, "detection" and "non-detection" alternately occur with respect to the obstacle in ganged relation to operation of the hydraulic excavator. In a case where the operator sets the control mode return time T2 to a value shorter than the total time used for returning, excavating, and 90° swinging, even if the operator has temporarily canceled vehicle body operation limitation and worked, a situation arises where "the control mode return time T2 elapses" in the state of "non-detection" during one cycle, allowing the controller 14 to return from the temporary cancelation mode to the normal mode. In this case, the operator needs to press the control canceling switch 36 per cycle, resulting in significantly reduced operability. In order to secure operability, the operator is expected to use the hydraulic excavator in the permanent cancelation mode where the controller 14 does not automatically return to the normal mode. However, using the hydraulic excavator in the permanent cancelation mode fails to increase safety as originally intended.

Conversely, in a case where the operator sets the control mode return time T2 to an unnecessarily long value (e.g., 10 minutes) by placing too much priority on preventing the controller 14 from automatically returning to the normal mode during work, since the hydraulic excavator operates in a control canceled state for a long period of time even after the periphery has been cleared of the item, increased safety as originally intended cannot be achieved.

Consequently, the control mode return time T2 is established taking into account operability and safety sufficiently in advance.

According to the present embodiment, moreover, the controller 14 further has a permanent cancelation mode that is a control mode for permanently canceling operation limiting control. The controller 14 determines in the normal mode whether the controller 14 is to shift to the temporary cancelation mode or the permanent cancelation mode depending on how the control canceling device (control canceling switch 36) is operated, and the controller 14 shifts, in the permanent cancelation mode, to the normal mode in response to operation of the control canceling device (control canceling switch 36). The control canceling device (control canceling switch 36) includes a momentary push-button switch. The controller 14 shifts to the temporary cancelation mode in a case where a continuously pressed time (control canceling switch ON time t1) of the control canceling switch 36 is shorter than a predetermined period of time (cancelation mode determining time T1) in the normal mode, and shifts to the permanent cancelation mode in a case where the continuously pressed time (control canceling switch ON time t1) of the control canceling switch 36 is equal to or longer than the predetermined period of time (cancelation mode determining time T1) in the normal mode.

It is thus possible for the controller to select shifting to the temporary cancelation mode or shifting to the permanent cancelation mode through operation of the single control canceling switch 36.

According to the present embodiment arranged as described above, it is possible to provide a construction machine that achieves both safety and operability by lowering the possibility of an accident due to contact between the construction machine and a worker in the periphery of the vehicle body while securing operability in situations where an item required for work is present in the periphery.

Second Embodiment

A second embodiment of the present invention will be described below with reference to FIG. 15. The present embodiment allows the controller 14 to shift from the normal mode to the temporary cancelation mode independently of operation of the control canceling switch 36. Differences from the first embodiment will mainly be described below.

Figure 15:
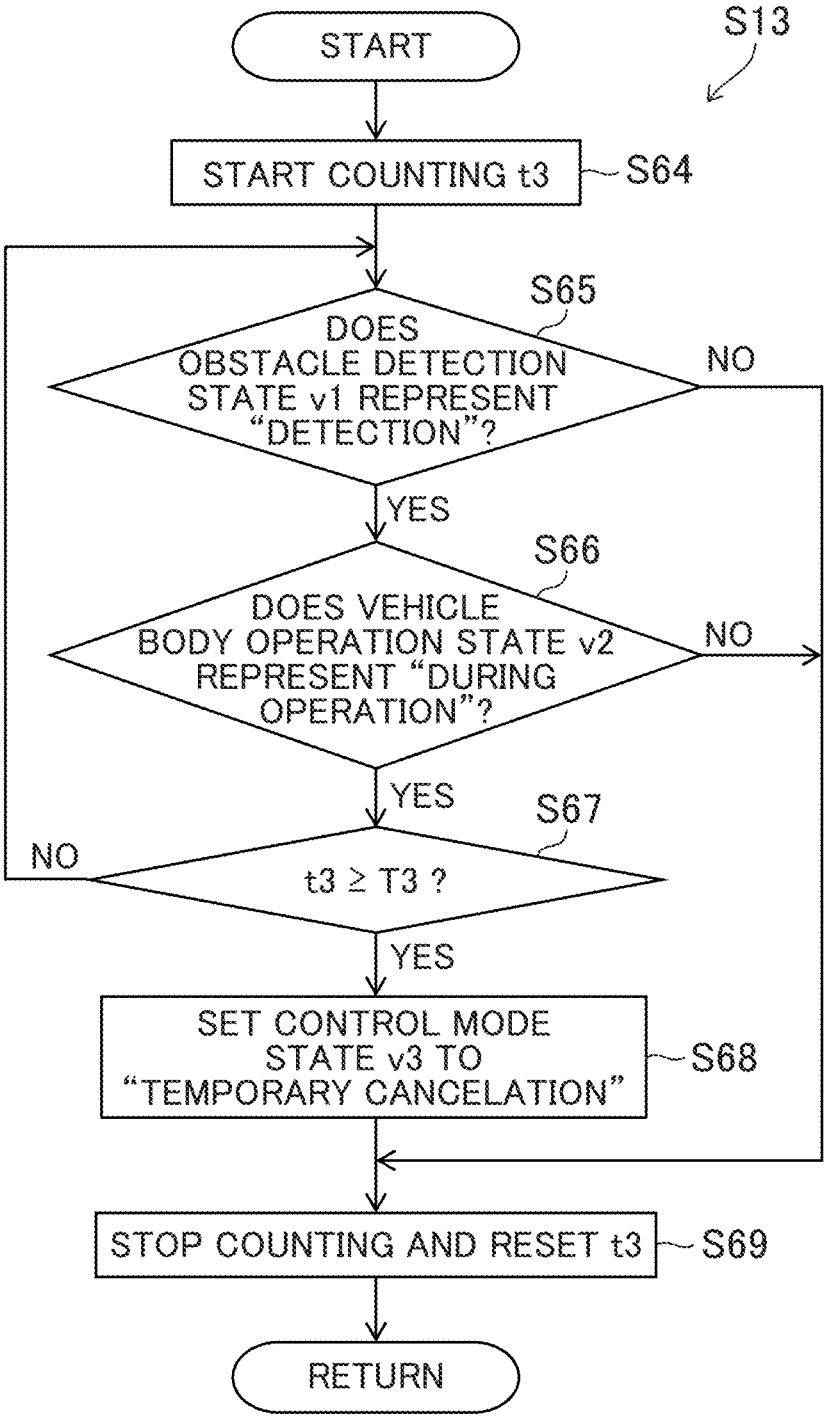
FIG. 15 is a flowchart of an additional processing sequence of a process of determining switching from a normal mode, as a subroutine of a controlled state switching determining section according to a second embodiment of the present invention.

FIG. 15 is a flowchart of an additional processing sequence of a process of determining switching from a normal mode (step S13), as a subroutine of a controlled state switching determining section 38 according to the present embodiment. Specifically, the controlled state switching determining section 38 according to the present embodiment carries out the processing sequence illustrated in FIG. 15 concurrent with the processing sequence illustrated in FIG. 9, as the process of determining switching from the normal mode (step S13).

First, the controlled state switching determining section 38 starts counting a during-detection operation time t3 (step S64).

Then, the controlled state switching determining section 38 determines whether the obstacle detection state v1 represents "detection" or not (step S65). If the obstacle detection state v1 does not represent "detection" (if the obstacle detection state v1 represents "non-detection"), then the controlled state switching determining section 38 stops counting the during-detection operation time t3, and resets the during-detection operation time t3 to a default value (0) (step S69), after which the processing sequence is ended.

If the obstacle detection state v1 represents "detection," then the controlled state switching determining section 38 determines whether the vehicle body operation state v2 represents "during operation" or not (step S66). If the vehicle body operation state v2 does not represent "during operation" (if the vehicle body operation state v2 represents "non-operation"), then the controlled state switching determining section 38 stops counting the during-detection operation time t3, and resets the during-detection operation time t3 to a default value (0) (step S69), after which the processing sequence is ended.

If the vehicle body operation state v2 represents "during-operation," then the controlled state switching determining section 38 determines whether or not the during-detection operation time t3 is equal to or longer than an automatic temporary cancelation shifting time T3 (e.g., 5 seconds) (step S67).

If the during-detection operation time t3 has reached the automatic temporary cancelation shifting time T3, then the controlled state switching determining section 38 sets the control mode state v3 to "temporary cancelation" (step S68), stops counting the during-detection operation time t3, and resets the during-detection operation time t3 to a default value (0) (step S69), after which the processing sequence is ended.

If the during-detection operation time t3 is shorter than the automatic temporary cancelation shifting time T3, then the processing sequence goes back to step S65 and repeats the process of determining the obstacle detection state v1 and the process of determining the vehicle body operation state v2.

The additional processing sequence of the process of determining switching from the normal mode, as illustrated in FIG. 15, makes it possible for the controller 14 to shift automatically to the temporary cancelation mode with the operator continuously operating the vehicle body without pressing the control canceling switch 36 while vehicle body operation limitation is being enabled with an obstacle detected during work in the normal mode.

Advantages of the Second Embodiment

According to the present embodiment, the hydraulic excavator further includes operation sensors (operation pressure sensors 29 through 31) for detecting whether the operation devices (operation levers 19 through 21) are operated or not, in which the controller 14 shifts to the temporary cancelation mode if the operation sensors (operation pressure sensors 29 through 31) have detected operation of the operation devices (operation levers 19 through 21) continuously over a predetermined period of time (automatic temporary cancelation shifting time T3) or longer while the obstacle sensors (3D sensors 6 through 9) are detecting an obstacle, other than in response to operation of the control canceling device (control canceling switch 36), in the normal mode.

When an obstacle is detected, vehicle body operation limitation is enabled, limiting the engine rotational speed to make operation of the vehicle body slower, and the swing pilot pressure interruption solenoid valve 34 and the travel pilot pressure interruption solenoid valve 35 are switched to the interruption position, making the vehicle body impossible to swing and travel. However, even though the obstacle is detected, it is necessary to cancel vehicle body operation limitation in order to move away from the obstacle and to continue work in the presence of the obstacle in the periphery after having checked safety in the periphery.

According to the first embodiment of the present invention, the control canceling switch 36 can cancel vehicle body operation limitation as a way of meeting such a need.

However, in a case where the control canceling switch 36 for canceling vehicle body operation limitation is located in a position different from that of the operation levers 19 through 21, the operator is required to take his/her hands off the operation levers 19 through 21 and then press the control canceling switch 36.

From the standpoint of prompting the operator to check safety in the periphery upon obstacle detection, it is effective for the operator to take his/her hands off the operation levers 19 through 21 in order to press the control canceling switch 36.

However, there may be predictable situations where, especially while working on sloped terrain or a road shoulder of muddy or irregular terrain, the vehicle body should not be stopped immediately, but should be moved a certain distance away from an obstacle and then stopped, thereby avoiding a new risk due to falling over, falling down, or slippage.

In certain limited situations, it may be better for the operator to keep moving the vehicle body until it can be stopped reliably in safety, rather than taking his/her hands off the operation levers 19 through 21 to press the control canceling switch 36 and stopping the vehicle body.

According to the present embodiment, even when an obstacle is detected, since the controller 14 shifts to the temporary cancelation mode to cancel vehicle body operation limitation when the operator has continuously operated the operation levers 19 through 21 for a certain period of time, it is possible to move the vehicle body to a place where it can be stopped in safety and change the posture of the vehicle body, without stopping the vehicle body.

Of course, inasmuch as when an obstacle is detected, it is desirable, in principle, for the operator to press the control canceling switch 36 to shift to the temporary cancelation mode after having stopped the vehicle body in safety as quickly as possible and checked safety in the vicinity, it is separately necessary to prompt the operator to pay attention to the fact that the function added according to the present embodiment is to be used as an emergency function.

While the embodiments of the present invention have been described hereinbefore, the present invention is not limited to the above embodiments and covers various modifications. For example, the above embodiments have been described in detail for easier understanding of the present invention; the present invention may not necessarily be limited to those including all the details described above. It is possible to add parts of some embodiments to those of other embodiments, and also to delete parts of some embodiments or replace them with parts of other embodiments.

DESCRIPTION OF REFERENCE CHARACTERS

1: Lower track structure
2: Upper swing structure
3: Front implement
3*a*: Boom
3*b*: Arm
3*c*: Bucket
3*d*: Boom cylinder (actuator)
3*e*: Arm cylinder (actuator)
3*f*: Bucket cylinder (actuator)
3*g*: Swing motor (actuator)
3*h*: Travel motor (actuator)
4: Cabin
5: Display device
6: 3D sensor (obstacle sensor)
7: 3D sensor (obstacle sensor)
8: 3D sensor (obstacle sensor)
9: 3D sensor (obstacle sensor)
10: Detection area
11: Detection area
12: Detection area
13: Detection area
14: Vehicle body controller (controller)
15: Lock switch
16: Switch box
17: Monitor controller
18: Periphery detection monitor
19: Swing operation lever (operation device)
20: Travel operation lever (operation device)
21: Front implement operation lever (operation device)
22: Engine
23: Engine controller
24: Hydraulic pump
25: Control valve
26: Hydraulic fluid source
27: Pump regulator
28: Lock valve (operation lock device)
29: Swing operation pressure sensor (operation sensor)
30: Travel operation pressure sensor (operation sensor)
31: Front implement operation pressure sensor (operation sensor)
32: Pump delivery pressure sensor
33: Pump flow rate control pressure sensor
34: Swing pilot pressure interruption solenoid valve
35: Travel pilot pressure interruption solenoid valve
36: Control canceling switch (control canceling device)
37: Operation limiting control section
38: Controlled state switching determining section
39: Operation limiting command section
40: Detection determining section
41: Operation state determining section
42: Solenoid valve actuating section
43: Engine rotation control section

The invention claimed is:

1. A construction machine comprising:
an actuator;
an operation device configured to instruct the actuator to operate;
a pilot pump configured to supply a pilot pressure to the operation device;
a controller configured to control operation of the actuator according to operation of the operation device; and
an obstacle sensor configured to detect an obstacle in a periphery of the construction machine, wherein
the controller is further configured to perform operation limiting control to limit the operation of the actuator when the obstacle sensor detects the obstacle,
the construction machine further comprises:
a control canceling switch configured to instruct canceling the operation limiting control;
a lock valve that is disposed on a supply line of the pilot pressure supplied from the pilot pump to the operation device and can be switched between a locked position for disabling the operation of the operation device by interrupting the pilot pressure supplied from the pilot pump to the operation device and an unlocked position for enabling the operation of the operation device by allowing the pilot pressure supplied from the pilot pump to the operation device;
a lock lever; and
a lock switch that is operated by the lock lever and instructs switching between the locked position and the unlocked position of the lock valve, and
the controller is further configured to:
have a normal mode as a control mode for making the operation limiting control effective and a temporary cancelation mode as a control mode for temporarily canceling the operation limiting control;
shift the operation limiting control to the temporary cancelation mode when the control canceling switch is operated while the operation limiting control is in the normal mode; and
shift the operation limiting control to the normal mode when a predetermined condition not responsive to operation of the control canceling switch is satisfied while the operation limiting control is in the temporary cancelation mode, wherein
the predetermined condition not responsive to operation of the control canceling switch is satisfied when the lock lever instructs the lock valve to be switched to the locked position.

2. The construction machine according to claim 1,
wherein the control canceling switch is a momentary pushbutton switch,
the controller is further configured to:
have a permanent cancelation mode as a control mode for permanently canceling the operation limiting control,
shift to the temporary cancelation mode when the pushbutton switch is operated in the normal mode and a continuously pressed time of the pushbutton switch is shorter than a predetermined period of time,
shift to the permanent cancelation mode when the pushbutton switch is operated in the normal mode and the continuously pressed time of the pushbutton switch is equal to or longer than the predetermined period of time, and
shift to the normal mode when the pushbutton switch is operated in the permanent cancelation mode.

3. The construction machine according to claim 1, further comprising:
an operation sensor for detecting whether the operation device is operated or not,
wherein the controller is further configured to shift to the temporary cancelation mode when a state in which the operation sensor detects operation of the operating device and in which the obstacle detection device detects the obstacle in the normal mode for a predetermined period of time or longer.

* * * * *